US008308266B2

(12) United States Patent
Numata et al.

(10) Patent No.: US 8,308,266 B2
(45) Date of Patent: Nov. 13, 2012

(54) LIQUID DROPLET EJECTING APPARATUS, LIQUID DROPLET EJECTING METHOD AND COMPUTER READABLE MEDIUM STORING A PROGRAM

(75) Inventors: Manabu Numata, Kanagawa (JP); Hiroshi Ikeda, Kanagawa (JP); Ken Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 350 days.

(21) Appl. No.: 12/427,857

(22) Filed: Apr. 22, 2009

(65) Prior Publication Data

US 2010/0123748 A1 May 20, 2010

(30) Foreign Application Priority Data

Nov. 19, 2008 (JP) ..... 2008-295120

(51) Int. Cl.
*B41J 29/393* (2006.01)
*B41J 29/38* (2006.01)

(52) U.S. Cl. ..... 347/19; 347/5; 347/9; 347/14

(58) Field of Classification Search ..... 347/19
See application file for complete search history.

(56) References Cited

U.S. PATENT DOCUMENTS

| | | | | |
|---|---|---|---|---|
| 5,477,244 | A * | 12/1995 | Shibata et al. | 347/19 |
| 5,892,315 | A * | 4/1999 | Gipson et al. | 310/317 |
| 6,935,728 | B2 * | 8/2005 | Kusunoki | 347/68 |
| 6,962,398 | B2 * | 11/2005 | Okuda et al. | 347/10 |
| 7,328,962 | B2 * | 2/2008 | Higuchi et al. | 347/19 |
| 2006/0244777 | A1 * | 11/2006 | Paasch | 347/19 |
| 2007/0279446 | A1 * | 12/2007 | Ishizaki | 347/19 |

FOREIGN PATENT DOCUMENTS

| | | | |
|---|---|---|---|
| EP | 1415809 | A2 * | 5/2004 |
| JP | 2006-137158 | | 6/2006 |
| JP | 2006-212868 | | 8/2006 |
| JP | 2006-289748 | | 10/2006 |

* cited by examiner

*Primary Examiner* — Stephen Meier
*Assistant Examiner* — Jeremy Bishop
(74) *Attorney, Agent, or Firm* — Fildes & Outland, P.C.

(57) ABSTRACT

A liquid droplet ejecting apparatus includes a liquid ejecting module and a measurement section. The liquid ejecting module includes a pressure chamber that has a piezoelectric element and an ejecting nozzle, and a supply passage that supplies liquid into the pressure chamber, and the liquid ejecting module configured to eject, from the ejecting nozzles, liquid which is supplied to the pressure chamber through the supply passage. The measurement section measures an admittance or a phase difference between a voltage applied to the piezoelectric element and a current through the liquid ejecting module when the voltage is applied.

11 Claims, 20 Drawing Sheets

FIG. 13A

| ELAPSED TIME T | LESS THAN $t_1$ ($t_1$=10 MINUTES) | $t_1$ TO LESS THAN $t_2$ ($t_1$=10 MINUTES, $t_2$=12 HOURS) | $t_2$ TO LESS THAN $t_3$ ($t_2$=12 HOURS, $t_3$=5 DAYS) | $t_3$ OR MORE THAN $t_3$ ($t_3$=5 DAYS) |
|---|---|---|---|---|
| PROCESSING | END | CALCULATE RESISTANCE R3 OF NOZZLE | CALCULATE RESISTANCE R1 OF PRESSURE CHAMBER | CALCULATE RESISTANCE R2 OF SUPPLY PASSAGE |

L.U.T OF ELAPSED TIME

FIG. 13B

| R2 VALUE | LESS THAN $R2_1$ | $R2_1$ TO LESS THAN $R2_2$ | $R2_2$ OR MORE THAN $R2_2$ | LESS THAN $R2_1$ BY RE-MEASUREMENT |
|---|---|---|---|---|
| CORRESPONDING VISCOSITY (INCREASED AMOUNT FROM REFERENCE VALUE) | LESS THAN 0.1 mPa·s | 0.1 TO LESS THAN 0.2 mPa·s | 0.2 mPa·s OR MORE THAN 0.2 mPa·s | LESS THAN 0.1 mPa·s |
| PROCESSING | CALCULATES RESISTANCE R1 OF PRESSURE CHAMBER | DISCHARGE DUMMY JET 10000 TIMES | SUCTION MAINTENANCE | END |

L.U.T AT THE TIME OF R2 CALCULATION

FIG. 13C

| R1 VALUE | LESS THAN $R11$ | $R11$ TO LESS THAN $R12$ | $R12$ OR MORE THAN $R12$ | LESS THAN $R11$ BY RE-MEASUREMENT |
|---|---|---|---|---|
| CORRESPONDING VISCOSITY (INCREASED AMOUNT FROM REFERENCE VALUE) | LESS THAN 0.5 mPa·s | 0.5 TO LESS THAN 3.0 mPa·s | 3.0 mPa·s OR MORE THAN 3.0 mPa·s | LESS THAN 0.5 mPa·s |
| PROCESSING | CALCULATES RESISTANCE R3 OF NOZZLE | DISCHARGE DUMMY JET 500 TIMES | SUCTION MAINTENANCE | END |

L.U.T AT THE TIME OF R1 CALCULATION

FIG. 13D

| R3 VALUE | LESS THAN $R31$ | $R31$ TO LESS THAN $R32$ | $R32$ OR MORE THAN $R32$ | LESS THAN $R31$ BY RE-MEASUREMENT |
|---|---|---|---|---|
| CORRESPONDING VISCOSITY (INCREASED AMOUNT FROM REFERENCE VALUE) | LESS THAN 0.5 mPa·s | 0.5 TO LESS THAN 2.0 mPa·s | 2.0 mPa·s OR MORE THAN 2.0 mPa·s | LESS THAN 0.5 mPa·s |
| PROCESSING | END | DISCHARGE DUMMY JET 50 TIMES | DISCHARGE DUMMY JET 250 TIMES | END |

L.U.T AT THE TIME OF R3 CALCULATION

FIG. 14

| FREQUENCY (HZ) | PHASE DIFFERENCE ACTUALLY MEASURED VALUE (° ) | THEORETICALLY CALCULATED VALUE (° ) | SQUARE OF DIFFERENCE |
|---|---|---|---|
| 125000 | 87 | 87.5 | ○○ |
| 250000 | 85 | 84.5 | ○○ |
| | | | |
| 1125000 | 84 | 84 | 0 |
| | | TOTAL SUM | ×× |

FIG. 20

| R3 VALUE | LESS THAN $R3_1$ | $R3_1$ TO LESS THAN $R3_2$ | $R3_2$ OR MORE THAN $R3_2$ |
|---|---|---|---|
| CORRESPONDING VISCOSITY (INCREASED AMOUNT FROM REFERENCE VALUE) | LESS THAN 0.5 mPa·s | 0.5 TO LESS THAN 1.0 mPa·s | 1.0 mPa·s OR MORE THAN 1.0 mPa·s |
| DJ NUMBER | 50 | 250 | 500 |

LIQUID DROPLET EJECTING APPARATUS, LIQUID DROPLET EJECTING METHOD AND COMPUTER READABLE MEDIUM STORING A PROGRAM

CROSS-REFERENCE TO RELATED APPLICATION

This application is based on and claims priority under 35 USC 119 from Japanese Patent Application No. 2008-295120 filed Nov. 19, 2008.

BACKGROUND OF THE INVENTION

1. Technical Field

The present invention relates to a liquid droplet ejecting apparatus, a liquid droplet ejecting method and a computer readable medium storing a program.

2. Related Art

It is known that ejection characteristics of an ink jet head (liquid droplet ejecting head) are changed by a change in ink viscosity (fluid viscosity), and the change of the ejection characteristics may have a negative influence on image quality.

SUMMARY

According to an aspect of the invention, there is provided a liquid droplet ejecting apparatus includes a liquid ejecting module and a measurement section. A liquid droplet ejecting apparatus includes a liquid ejecting module and a measurement section. The liquid ejecting module includes a pressure chamber that has a piezoelectric element and an ejecting nozzle, and a supply passage that supplies liquid into the pressure chamber, and the liquid ejecting module configured to eject, from the ejecting nozzles, liquid which is supplied to the pressure chamber through the supply passage. The measurement section measures an admittance or a phase difference between a voltage applied to the piezoelectric element and a current through the liquid ejecting module when the voltage is applied.

BRIEF DESCRIPTION OF THE DRAWINGS

Exemplary embodiments of the present invention will be described in detail based on the following figures, wherein:

FIG. 13A is a look up table (L. U. T) of elapsed time, FIG. 13B shows L. U. T at the time of calculation of R2, FIG. 13C shows L. U. T at the time of calculation of R1 and FIG. 13D shows L. U. T at the time of calculation of R3;

FIG. 14 is a diagram showing a phase difference actually measured value with respect to frequency and a theoretically calculated value concerning the curve fitting, and a square relation of a difference between the phase difference actually measured value and the theoretically calculated value;

FIG. 20 is a diagram showing one example of L. U. T for determining the number of dummy jets in a second exemplary embodiment.

DETAILED DESCRIPTION

Exemplary embodiments of the present invention will be explained in detail with reference to the drawings below. In the exemplary embodiments, a liquid droplet ejecting apparatus is an ink jet printer, and liquid to be ejected is ink liquid.

Figure 1:
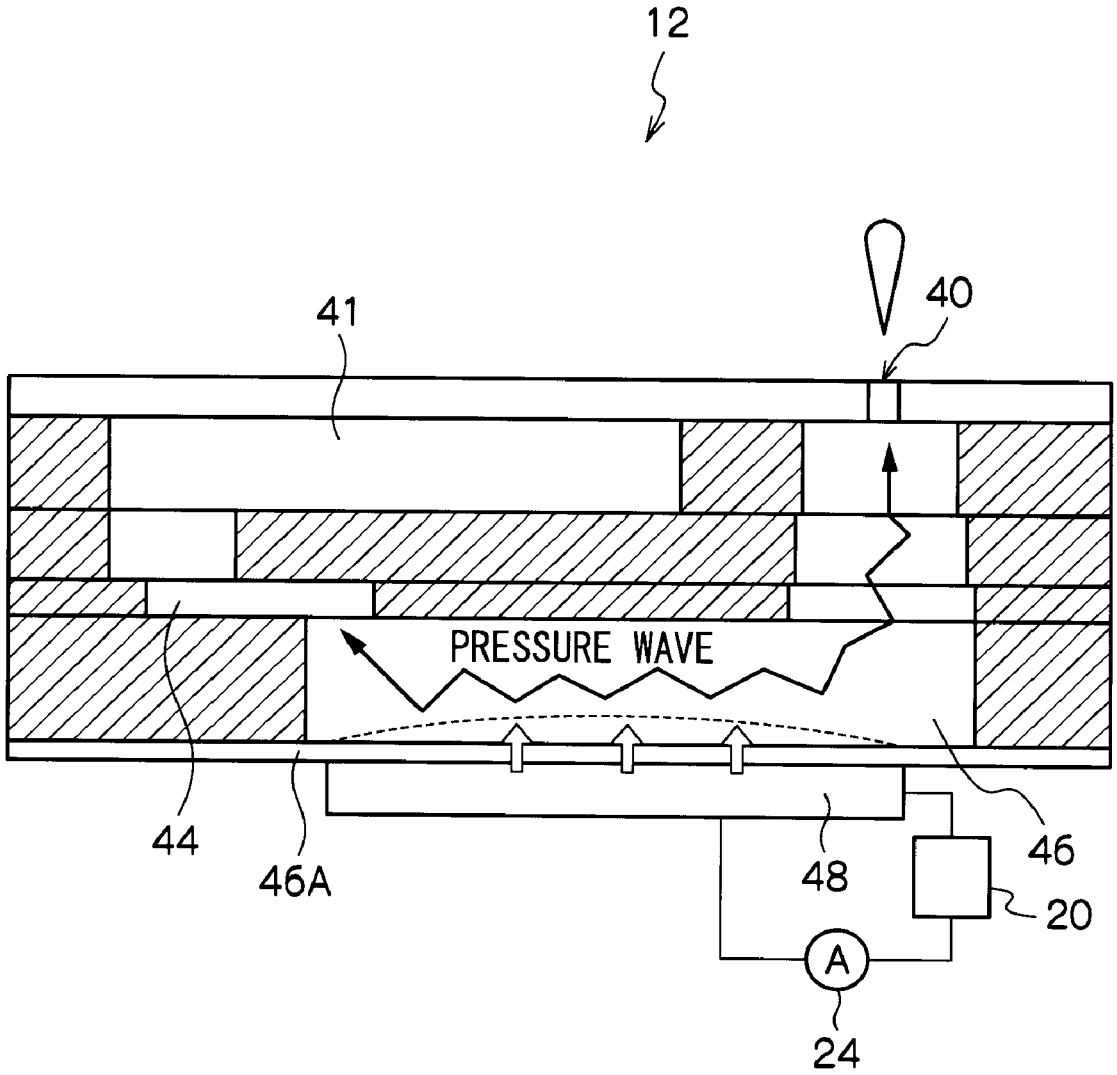
FIG. 1 is a schematic sectional view showing a structure of a liquid ejecting module provided in an ink jet printer according to the exemplary embodiment.

As shown in FIG. 1, a liquid ejecting module 12 provided in an ink jet printer according to a first exemplary embodiment includes ejecting nozzles 40, an ink chamber 41, a supply passage 44 which is a passage of a space chamber, a pressure chamber 46 and piezoelectric elements 48. The plural ejecting nozzles 40 through which liquid droplets are ejected are disposed in a matrix form in the liquid ejecting module 12. Liquid droplets of ink liquid are ejected from the ejecting nozzles 40, and an image is recorded on a recording sheet.

A proper amount of ink liquid is supplied to the ink chamber 41 from an ink cartridge (liquid storage tank) (not shown), and the ink liquid is temporality stored therein. The ink chamber 41 is in communication with the pressure chamber 46 through a supply passage (throttle portion) 44, and the pressure chamber 46 is in communication with outside through the ejecting nozzles 40.

A portion of a wall surface of the pressure chamber 46 is constituted by a vibrating wall 46A. The piezoelectric element 48 is mounted on the vibrating wall 46A in a surface-contact manner. The piezoelectric element 48 is deformed in accordance with driving waveform of alternating voltage (or voltage in which AC and DC are superimposed), a pressure on the vibrating wall 46A is varied (vibrated), thereby generating volume variation (contraction and expansion) in the pressure chamber 46.

The ink liquid stored in the ink chamber 41 is ejected from the ejecting nozzles 40 through the supply passage 44 and the pressure chamber 46 by pressure wave (vibration wave) of the ink liquid generated by the volume variation in the pressure chamber 46. At that time, a current value in the alternating voltage applied by the alternating voltage generator 20 is measured by an ammeter 24.

Figure 2:
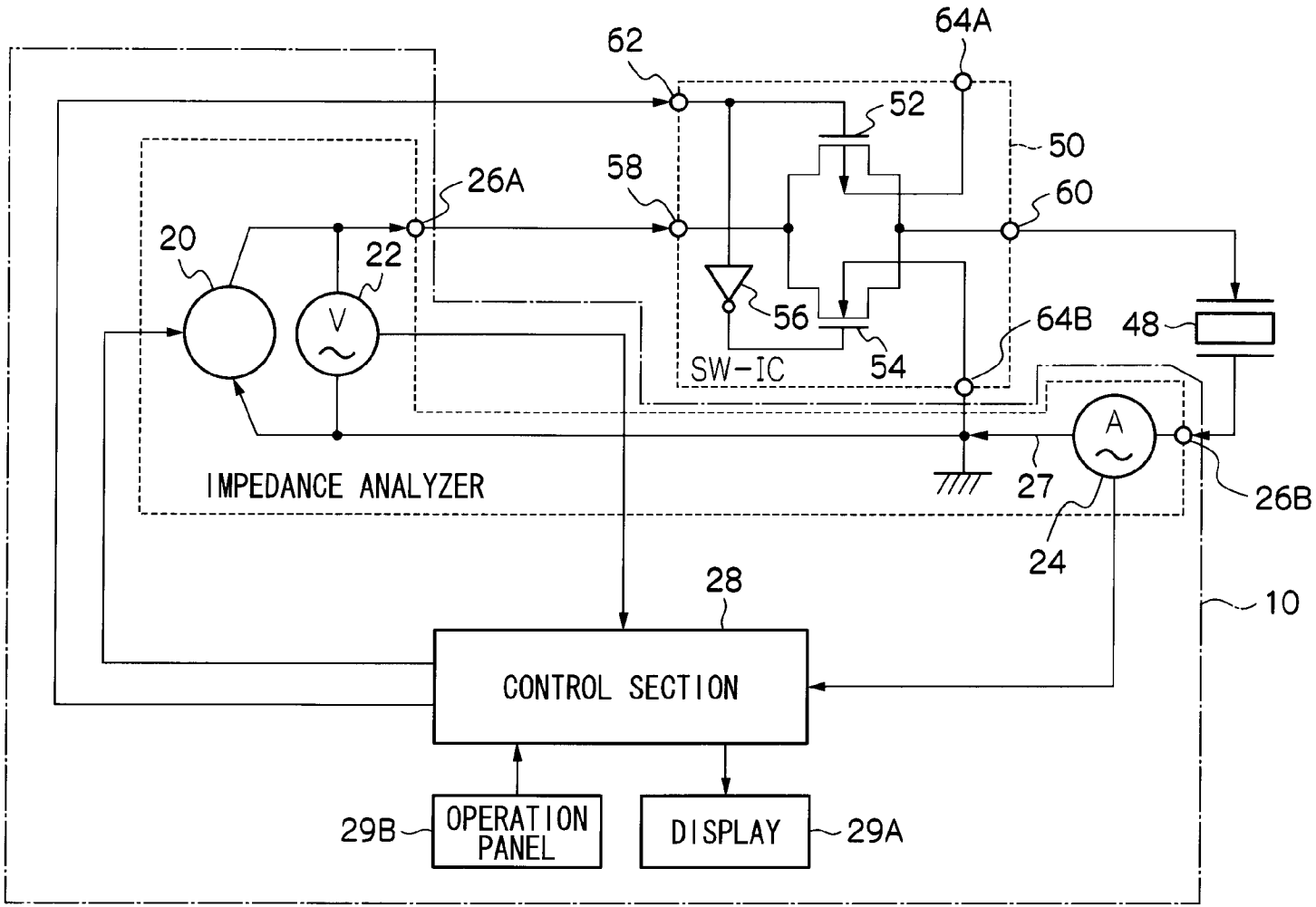
FIG. 2 is a schematic diagram showing a structure of a portion related to a liquid ejecting module provided in the ink jet printer of the exemplary embodiment.

As shown in FIG. 2, a switch IC (integrated Circuit) (SW-IC, hereinafter) 50 which controls voltage to be applied to the piezoelectric elements 48, and a control unit 10 having a function of carrying out maintenance suitable for viscosity of ink liquid are connected to the liquid ejecting module 12.

The SW-IC 50 includes a P-channel MOS type (Metal Oxide Semiconductor) field-effect transistor (FET) (PMOSFET, hereinafter) 52, an N-channel MOS type field-effect transistor (NMOSFET, hereinafter) 54, an inverter 56, an inspection voltage input terminal 58, a voltage output terminal 60, a control signal input terminal 62, a back gate terminal 64A and a back gate terminal 64B.

According to the SW-IC 50 of the exemplary embodiment, each piezoelectric element 48 includes the PMOSFET 52, the NMOSFET 54, the inverter 56, the voltage output terminal 60 and the control signal input terminal 62, but in FIG. 2, only those provided in correspondence with one piezoelectric element 48 are illustrated.

In the SW-IC 50, the inspection voltage input terminal 58, the back gate terminal 64A and the back gate terminal 64B are provided only one each.

A source of the PMOSFET 52 and a drain of the NMOSFET 54 are connected to the inspection voltage input terminal 58. A drain of the PMOSFET 52 and a source of the NMOSFET 54 are connected to one of electrodes of the corresponding piezoelectric element 48 through the voltage output terminal 60.

A gate of the PMOSFET 52 is directly connected to the control signal input terminal 62, and a gate of the NMOSFET 54 is connected to the control signal input terminal 62 through the inverter 56.

Aback gate of the PMOSFET 52 is connected to the back gate terminal 64A, and a back gate of the NMOSFET 54 is grounded through the back gate terminal 64B. Voltage of a predetermined voltage level is applied to the back gate terminal 64A from a power supply device (not shown) of the ink jet printer.

The control unit 10 includes the alternating voltage generator 20, a voltmeter 22, the ammeter 24, the control section 28, two inspection voltage output terminals 26A and 26B, a display 29A and an operation panel 29B.

One of terminals of the alternating voltage generator 20 is connected to the inspection voltage output terminal 26A, the other terminal is grounded and is connected to the inspection voltage output terminal 26B. The alternating voltage generator 20 generates sine waveform alternating voltage by the control from a control section 28, and changes frequency of the generated alternating voltage.

The voltmeter 22 is connected to both one and the other terminals of the alternating voltage generator 20, and outputs a potential difference signal indicative of a potential difference between the both terminals to the control section 28.

The ammeter 24 is provided on a wire 27 connecting the other terminal of the alternating voltage generator 20 and the inspection voltage output terminal 26B. The ammeter 24 measures current flowing to the wire 27, and outputs a current value signal indicative of the measured current value to the control section 28.

Figure 3:
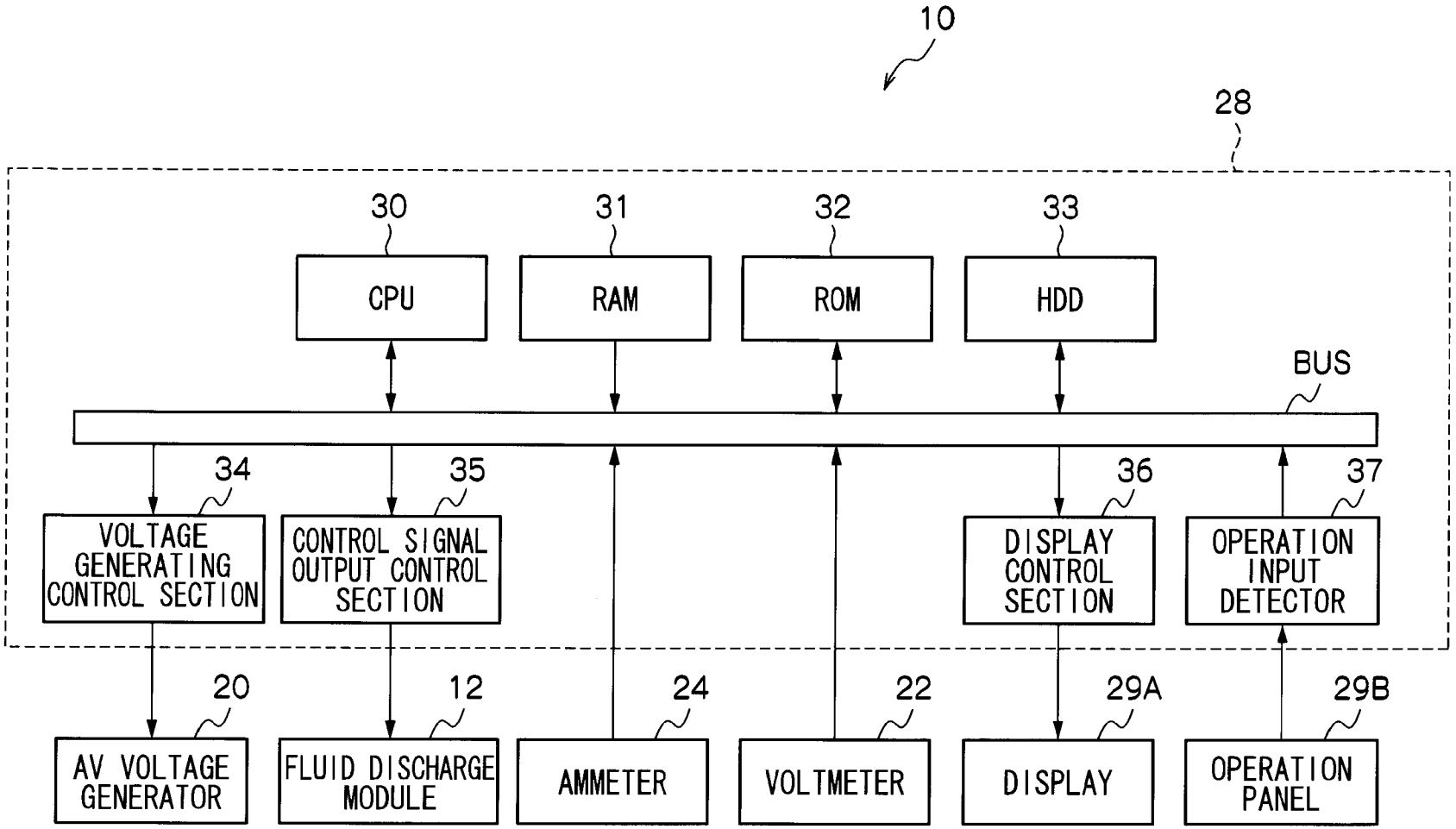
FIG. 3 is a block diagram showing a structure of a control section of the ink jet printer of the exemplary embodiment.

As shown in FIG. 3, the control section 28 of the control unit 10 includes a CPU (Central Processing Unit) for controlling operations of the entire apparatus 30, a RAM (Random Access Memory) 31 used as a work area when various processing programs are executed by the CPU 30, a ROM (Read Only Memory) 32 in which various control programs and various parameters are previously stored, a HDD (Hard Disk Drive) 33 in which various information sets are stored, a voltage generating control section 34 which controls a generating operation of alternating voltage by the alternating voltage generator 20, a control signal output control section 35 which controls output of a control signal for selecting one of the ejecting nozzles 40 provided in the liquid ejecting module 12 to be measured, a display control section 36 which controls display, on the display 29A, of various information sets such as an operating menu and message, and an operation input detector 37 which detects operation on the operation panel 29B.

A potential difference signal which is output from the voltmeter 22 and a current value signal which is output from the ammeter 24 are input to the control section 28.

The CPU 30, the RAM 31, the ROM 32, the HDD 33, the voltage generating control section 34, the control signal output control section 35, the display control section 36 and the operation input detector 37 are connected to each other through a system bus BUS.

Therefore, the CPU 30 controls access to the RAM 31, the ROM 32 and the HDD 33, controls generation of alternating voltage by the alternating voltage generator 20 through the voltage generating control section 34, controls output of a control signal from the control signal output control section 35, and controls display of various information sets such as operation screen and various messages on the display 29A through the display control section 36. Further, the CPU 30 grasps operation on the operation panel 29B based on operation information detected by the operation input detector 37, and grasps a potential difference between both the terminals of the alternating voltage generator 20 and a current value flowing to the wire 27 based on a potential difference signal, a potential difference signal which is input from the ammeter 24, and a current value signal.

Figure 4:
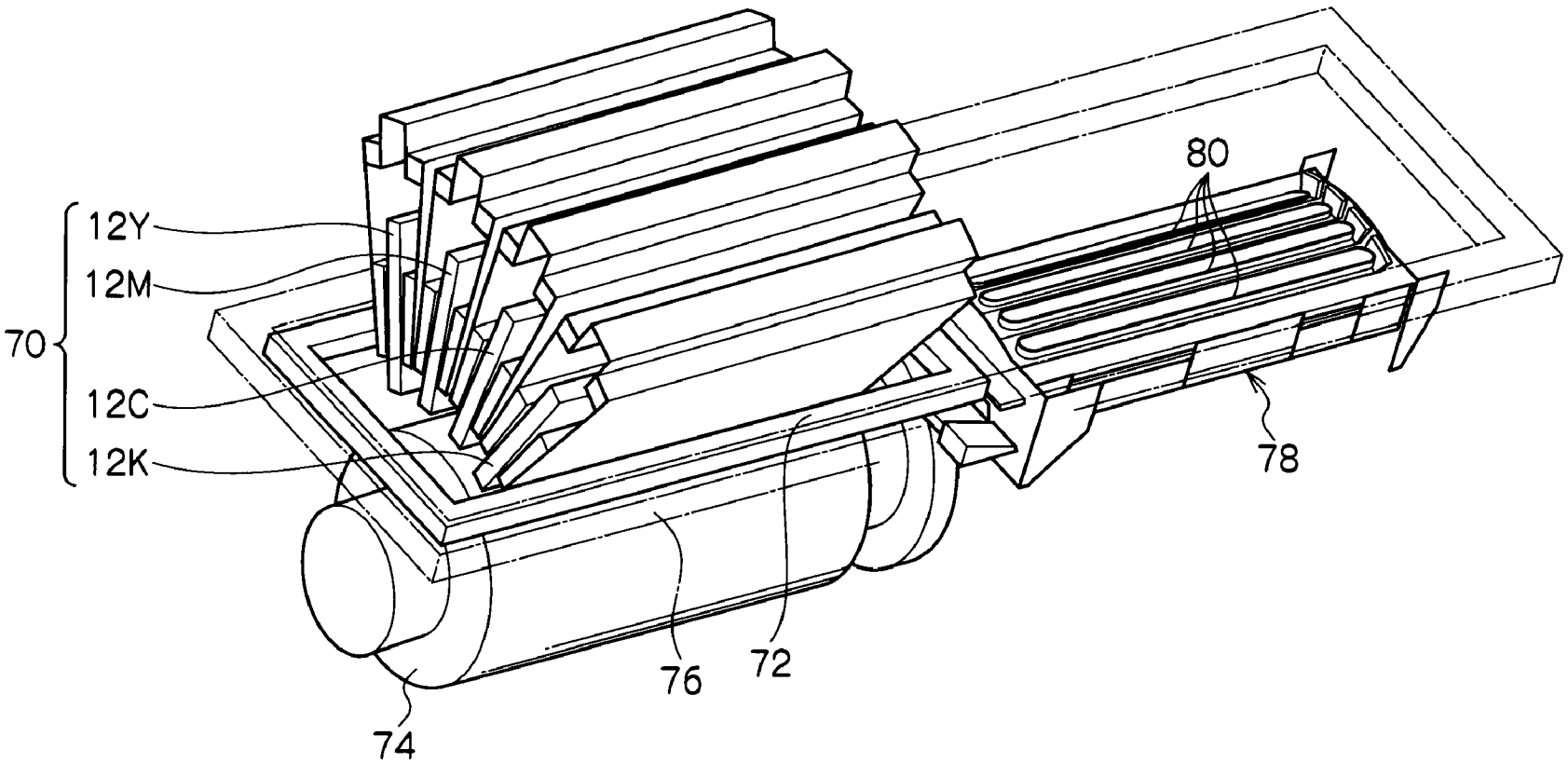
FIG. 4 is a schematic perspective view of a portion related to a recording head and a maintenance unit of the ink jet printer of the exemplary embodiment.

As shown in FIG. 4, the ink jet printer of the exemplary embodiment includes the following liquid ejecting modules 12, i.e., a liquid ejecting module 12Y for discharging yellow (Y) ink liquid, a liquid ejecting module 12M for discharging magenta (M) ink liquid, a liquid ejecting module 12C for discharging cyan (C) ink liquid, and a liquid ejecting module 12K for discharging black (K) ink liquid. These four liquid ejecting modules 12 constitute a recording head 70. The recording head 70 has a recordable region which is about the same or greater than the maximum width of recording sheets on which it is assumed to record an image.

For contents which are in common for the liquid ejecting modules 12Y, 12M, 12C and 12K, symbols Y, M, C and K will be omitted.

The recording head 70 is held by a head holder 72, and the liquid ejecting modules 12 of the recording head 70 are disposed along a circumferential direction on an outer peripheral surface of the conveying drum 74 at predetermined angles therebetween.

The head holder 72 is provided at its lower portion with a frame body 76 extending in a direction intersecting with a conveying direction of recording sheets P. The head holder 72 can horizontally move in the frame body 76 between a printing region opposed to the conveying drum 74 and a standby region where a later-described maintenance unit 78 is provided.

The head holder 72 may be horizontally moved using a linear motor (not shown), or may be horizontally moved through a pinion and a rack using a rotation motor.

The maintenance unit 78 is provided for each of the liquid ejecting modules 12 on the standby region side of the head holder 72 in the frame body 76. The maintenance unit 78 is provided with a cap member 80. The cap member 80 prevents viscosity of ink liquid in the liquid ejecting module 12 from increasing due to the opened ejecting nozzle 40 surface, and the cap member 80 is used when ink liquid in the liquid ejecting module is drawn.

A suction pump which sucks ink in the liquid ejecting module 12 is provided in the cap member 80. In a state where the recording head 70 is mounted on the maintenance unit 78 and each ejecting nozzle 40 is capped with the cap member 80, ink liquid in the liquid ejecting module 12 is sucked by suction of the suction pump.

As described above, the control section 28 has a function of carrying out maintenance corresponding to viscosity η of ink liquid charged into the pressure chamber 46 which is to be ejected from the ejecting nozzles 40. This maintenance is executed by the CPU 30 in accordance a maintenance program which is previously stored in the ROM 32. A viscosity measuring principle used when voltage is applied to the piezoelectric element 48 (see FIG. 1) and ink viscosity is measured from the voltage-current phase difference will be explained.

As shown in FIG. 1, voltage is applied to the piezoelectric element 48, an equivalent circuit showing electric characteristics of the liquid ejecting module 12 at that time and an equivalent circuit showing acoustic characteristics of a flow passage of the liquid ejecting module 12 are assumed, and an admittance/phase difference is measured.

If physical properties of ink liquid are changed on a surface of the ejecting nozzle 40, a measured value of the admittance/phase difference is varied, and viscosity variation of the ink liquid is detected from the numeric value. Since the viscosity corresponds to resistance of various portions of the supply passage 44, the pressure chamber 46 and the ejecting nozzles 40 of the liquid ejecting module 12, the viscosity variation of the various portions is detected by detecting variation in resistance value of the various portions from the variation in phase difference.

Figure 5A:
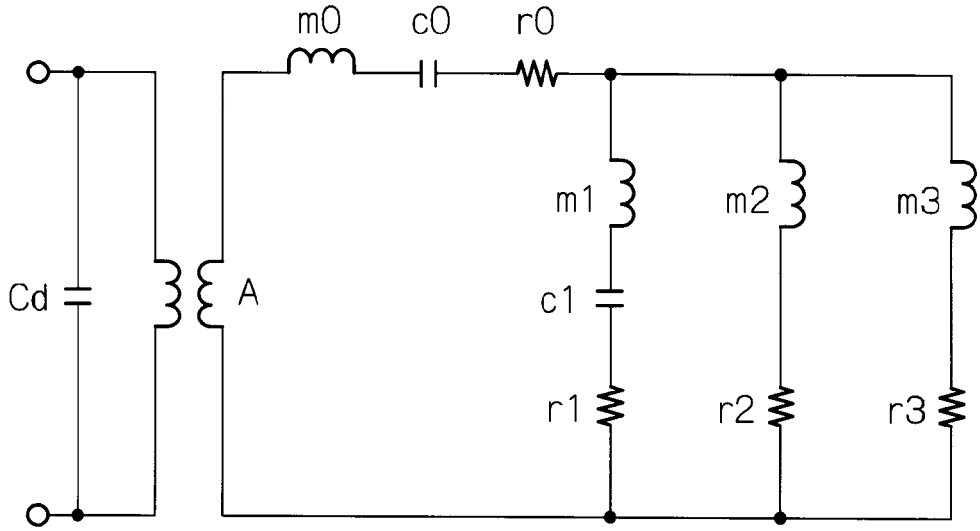
FIG. 5A is an equivalent circuit diagram showing acoustic characteristics of a liquid ejecting module 12.

FIG. 5A is an equivalent circuit ("acoustic characteristics equivalent circuit", or "second equivalent circuit" hereinafter) diagram showing acoustic characteristics of the liquid ejecting module 12. Here, r1 represents acoustic resistance of the pressure chamber, r2 represents acoustic resistance of the supply passage, and r3 represents acoustic resistance of the ejecting nozzle. When it is not necessary to distinguish the pressure chamber, the supply passage and the ejecting nozzle from each other and the acoustic resistances are collectively called, only a reference symbol "r" is added (without adding numerical values).

Figure 5B:
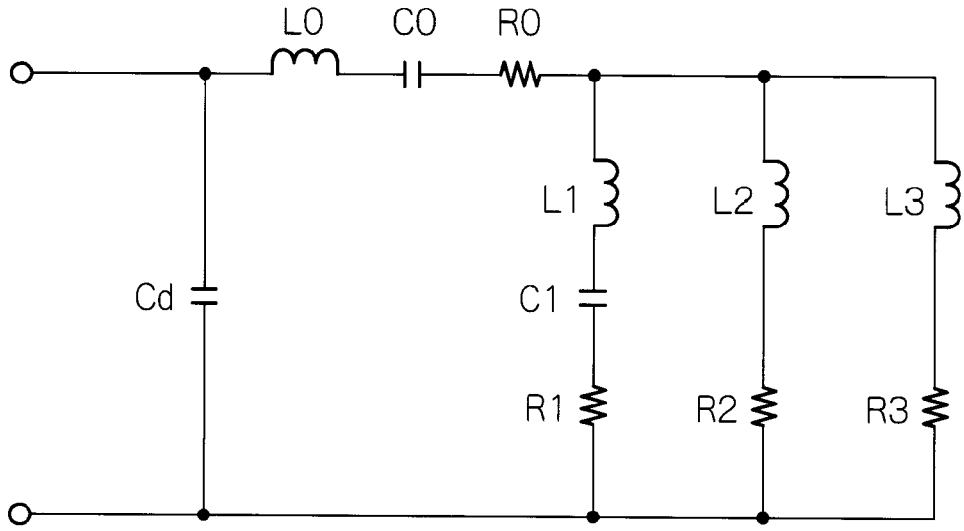
FIG. 5B is an equivalent circuit diagram showing electric characteristics.

FIG. 5B is an equivalent circuit ("electric characteristics equivalent circuit", or "first equivalent circuit" hereinafter) diagram showing electric characteristics of the liquid ejecting module 12. Here, R1 represents electric resistance of the pressure chamber, R2 represents electric resistance of the supply passage, and R3 represents electric resistance of the ejecting nozzle. When it is not necessary to distinguish the pressure chamber, the supply passage and the ejecting nozzle from each other and the electric resistances are collectively called, only a reference symbol "R" is added (without adding numerical values).

A transformation of variable between the acoustic characteristics equivalent circuit (second equivalent circuit) shown in FIG. 5A and electric characteristics equivalent circuit (first equivalent circuit) shown in FIG. 5B is expressed by the following equations (1) to (3).

$$R=r/A^2 \tag{1}$$

$$L=m/A^2 \tag{2}$$

$$C=cA^2 \tag{3}$$

Here, a symbol L represents reactance in the electric characteristics equivalent circuit, a symbol C represents capacitance in the electric characteristics equivalent circuit, a symbol m represents inertance in the acoustic characteristics equivalent circuit, a symbol c represents acoustic capacity in the acoustic characteristics equivalent circuit, and a symbol A represents electric acoustic conversion coefficient.

If attention is paid to acoustic resistance r in the second equivalent circuit, "p" of differential equation (acoustic differential equation, see equation (4)) at the second equivalent circuit showing the acoustic characteristics corresponds to "e" of differential equation (electric differential equation, see equation (5)) at the first equivalent circuit showing electric characteristics. Further, "u" of the acoustic differential equation corresponds to "i" of the electric differential equation.

$$p=r\cdot u \tag{4}$$

$$e=R\cdot i \tag{5}$$

wherein, p represents pressure, u represents volume speed, e represents voltage, and i represents current.

Concerning acoustic resistance r which is a coefficient of the acoustic differential equation of the equation (4), acoustic resistance r3 of the ejecting nozzle is as shown in the equation (6).

$$r3=\frac{128\times\eta}{\pi}\times\int_0^l\frac{1}{\frac{D2-D1}{le}-D1}dx=\frac{128\times\eta\times le}{\pi}\times\frac{D1^2+D1\times D2+D2^2}{3\times D1^3\times D2^3} \tag{6}$$

Here, η represents viscosity of ink liquid, D1 represents minimum cross section diameter of the flow passage in the liquid ejecting module 12, D2 represents maximum cross section diameter of the flow passage in the liquid ejecting module 12, and le represents length of the flow passage.

Acoustic resistance r1 of the pressure chamber and acoustic resistance r2 of the supply passage can also be obtained as coefficients of the acoustic differential equation of the equation (4) which is determined by the relation between the flow passage structure and the viscosity. When the pressure chamber 46 and the supply passage 44 are regarded as flow passages having rectangular cross sections, the acoustic resistance r1 of the pressure chamber and acoustic resistance r2 of the supply passage are obtained by the following equation (7).

$$r1,\ r2=\frac{12\times\eta\times le}{S^2}\left\{0.33+1.02\left(z+\frac{1}{z}\right)\right\} \tag{7}$$

wherein, S2 represents a cross section of the flow passage, and z represents an aspect ratio (a/b, a: long side of the rectangle, b: short side of the rectangle) of the flow passage cross section.

If the resistance in the electric characteristics equivalent circuit (first equivalent circuit) can be calculated from the relation between the acoustic characteristics and the electric characteristics, viscosity η can easily be obtained by converting this into acoustic resistance of the acoustic characteristics equivalent circuit (second equivalent circuit).

That is, resistance R1 of the pressure chamber, resistance R2 of the supply passage and resistance R3 of the ejecting nozzle are calculated, and viscosity of ink liquid in the pressure chamber, viscosity of ink liquid in the supply passage and viscosity of ink liquid in the ejecting nozzle can be obtained based on acoustic resistance r1 of the pressure chamber, acoustic resistance r2 of the supply passage and acoustic resistance r3 of the ejecting nozzle which are obtained as a conversion equation of the equation (1) and an acoustic differential equation coefficient r of the equation (4).

To obtain resistance R in the electric characteristics equivalent circuit (first equivalent circuit), it is necessary to carry out the following three processing.

(Processing 1 to be Executed)

Figure 6:
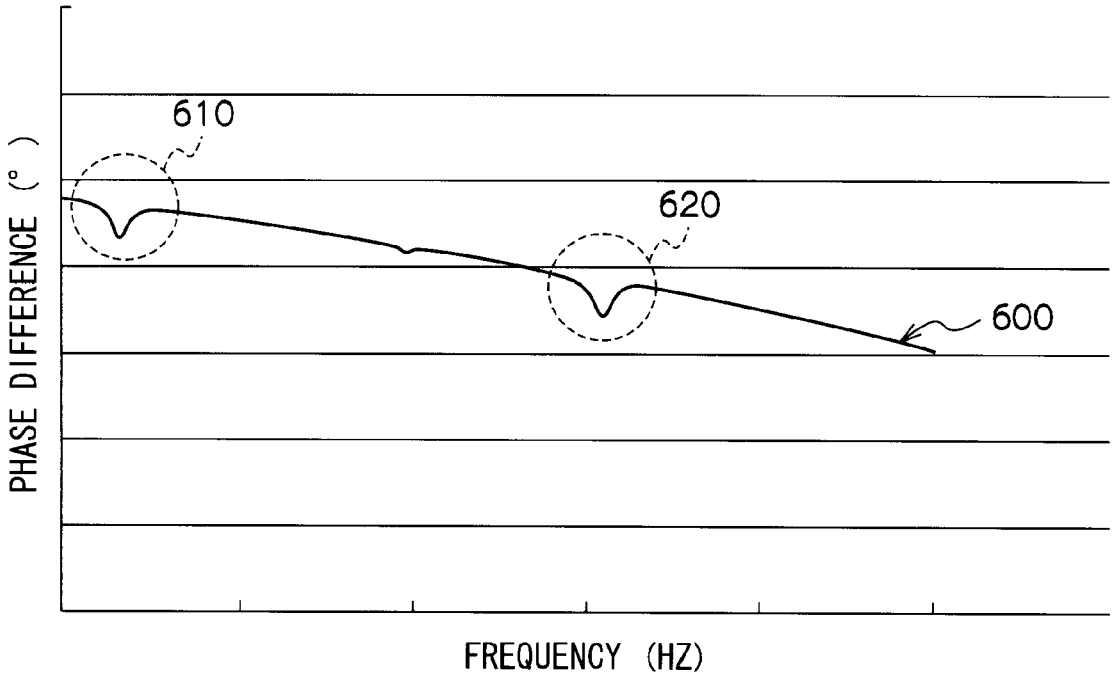
FIG. 6 is a diagram showing one example of frequency-phase difference characteristics.

Frequency of power source to be applied is changed (in this exemplary embodiment, in a range of 10000 Hz to 1010000 Hz, sampling frequency unit is 2500 Hz), and phase difference between voltage and current of the power source is obtained (see frequency-phase difference characteristics diagram in FIG. 6).

As shown in FIG. 6, a first region 610 on the side of a low frequency region and a second region 620 on the side of a high frequency region in a region which resonates on a first waveform 600 showing a relation between frequency of the actually measured value and phase difference exist in the frequency-phase difference characteristics.

(Processing 2 to be Executed)

Curve fitting processing in resonance position of the frequency-phase difference characteristics is executed.

(Processing 3 to be Executed)

Equivalent circuits at resonance point in the low frequency region and high frequency region are assumed. Here, FIG. 7 shows an equivalent circuit in the low frequency region and FIG. 8 shows an equivalent circuit in the high frequency region.

After that (after curve fitting), numeric values of L1, C1 and R1 components are obtained from the equivalent circuit in the high frequency region, and numeric values of L2, R2, L3 and R3 components are obtained from the equivalent circuit in the low frequency region. Therefore, resistances R1, R2 and R3 can be calculated.

Figure 7:
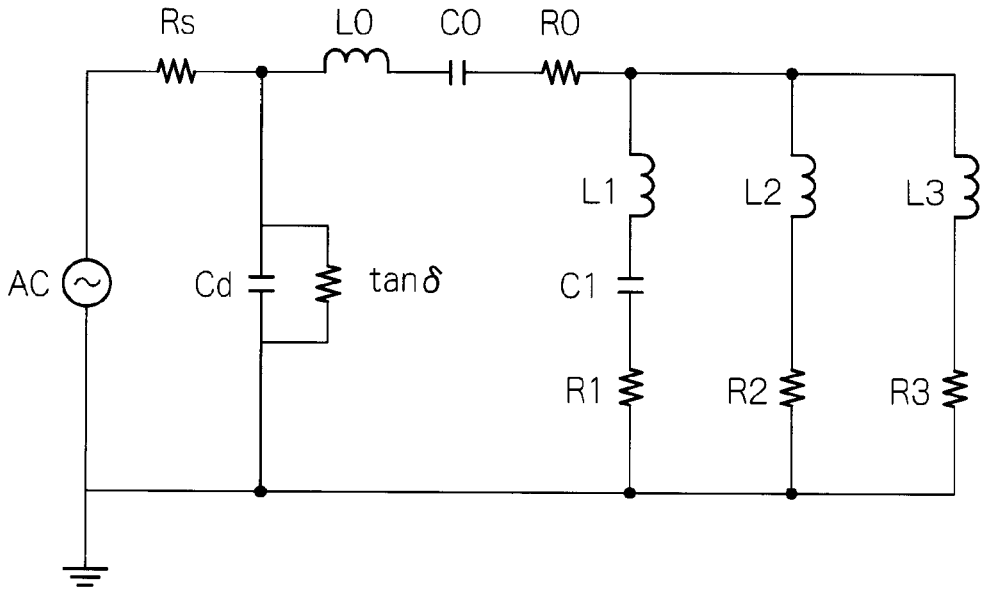
FIG. 7 is a low frequency-side equivalent circuit diagram for carrying out curve fitting according to the exemplary embodiment of invention.
Figure 8:
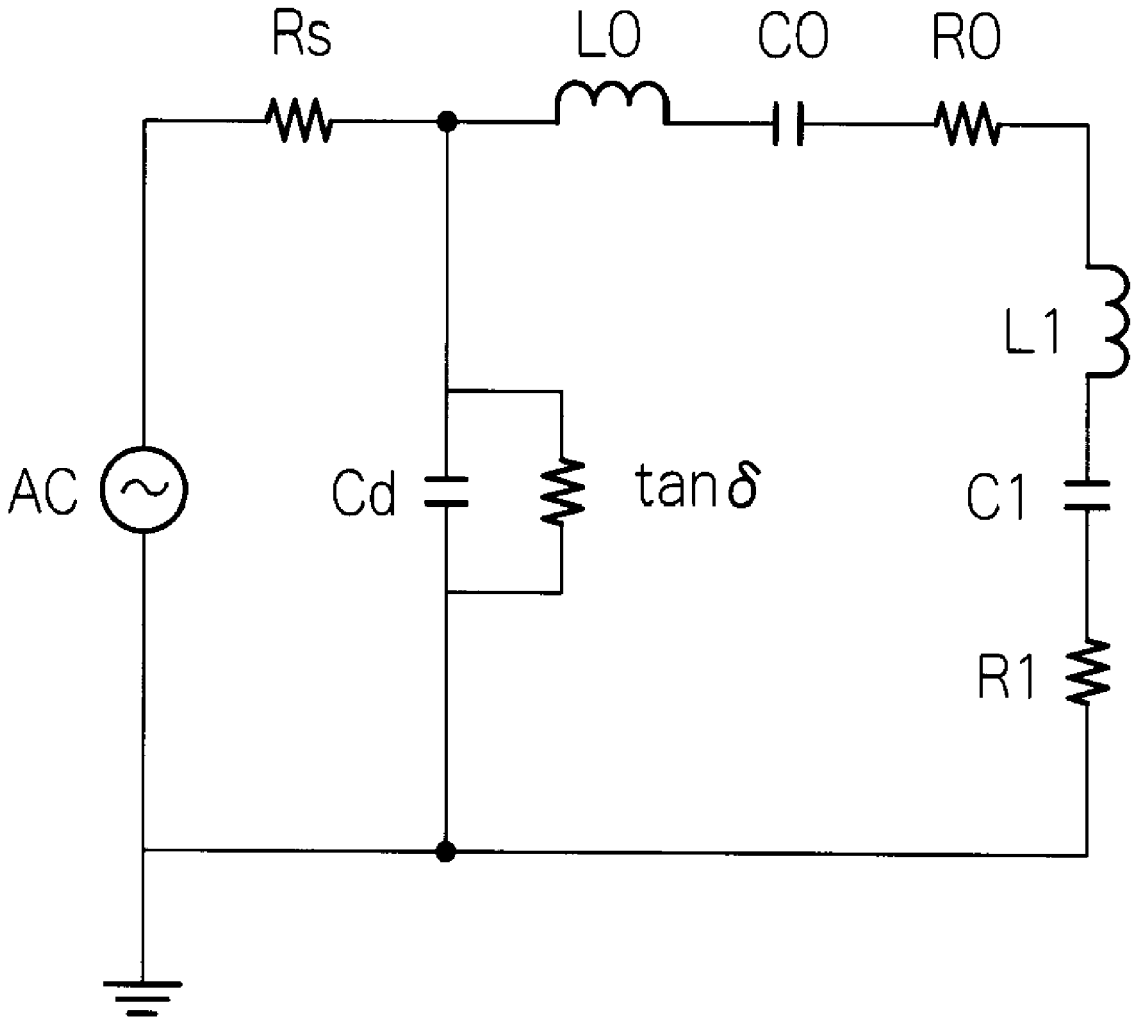
FIG. 8 is a high frequency-side equivalent circuit diagram for carrying out curve fitting according to the exemplary embodiment of invention.
Figure 9A:
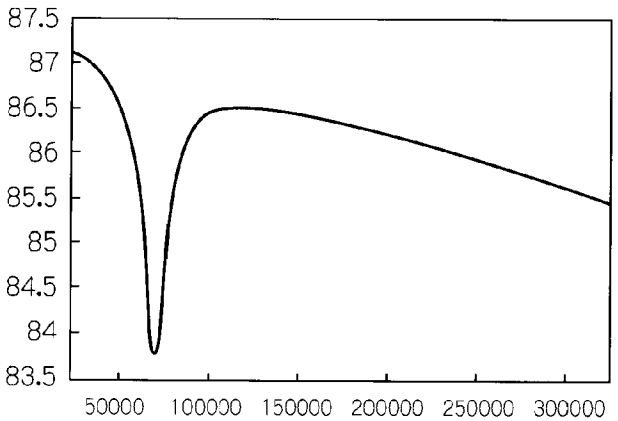
FIGS. 9A to 9D are diagrams showing one example of the frequency-phase difference characteristics when viscosity $\eta$ is varied.
Figure 9B:
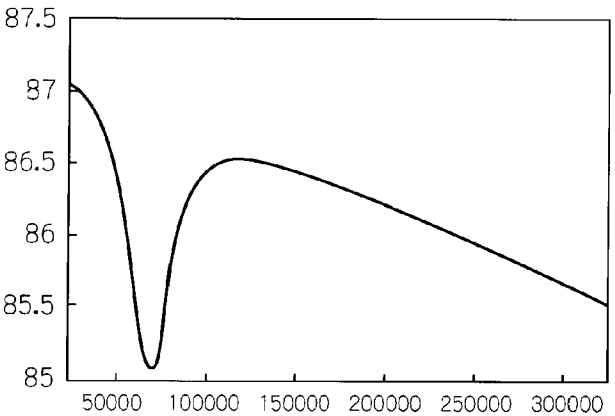
Figure 9C:
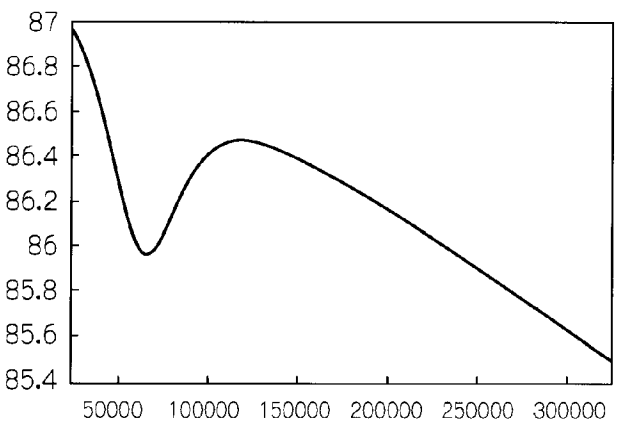
Figure 9D:
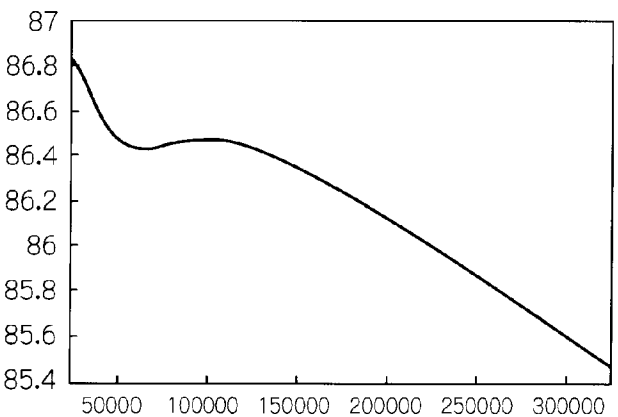

The electric characteristics equivalent circuit (first equivalent circuit) of the exemplary embodiment is equal to FIG. 7 (low frequency region). In the equivalent circuit in the high frequency region, it can be found that elements which are common in FIG. 7 are L1, C1 and R1. In the equivalent circuit of low frequency, since the elements (L1, C1 and R1) are very small values, they are specified by the equivalent circuit in FIG. 8 in which the elements (L1, C1 and R1) become noticeable, and they are appropriated for the same elements (L1, C1 and R1) in the equivalent circuit shown in FIG. 7.

The numeric value of resistance R of the identified first equivalent circuit is substituted in the equation (1) to obtain the acoustic resistance r, and each viscosity η is obtained based on the obtained r.

In this exemplary embodiment, it is only necessary that maintenance suitable for the viscosity η can be carried out. Hence, since the resistance R and viscosity η are in a linear relation as apparent from equations (1) and (7) also, it is unnecessary to obtain the viscosity η and it is only necessary to calculate the resistance R.

FIG. 9 are frequency-phase difference characteristics diagrams when viscosity η is varied. FIG. 9A shows that viscosity η is 3 [mPa·s], FIG. 9B shows that viscosity η is 5 [mPa·s], FIG. 9C shows that viscosity η is 10 [mPa·s], and FIG. 9D shows that viscosity η is 20 [mPa·s]. As shown in FIGS. 9A to 9D, it can be found that variation in resistance (R2 or R3) of resonance frequency has correlation with viscosity η.

Figure 10:
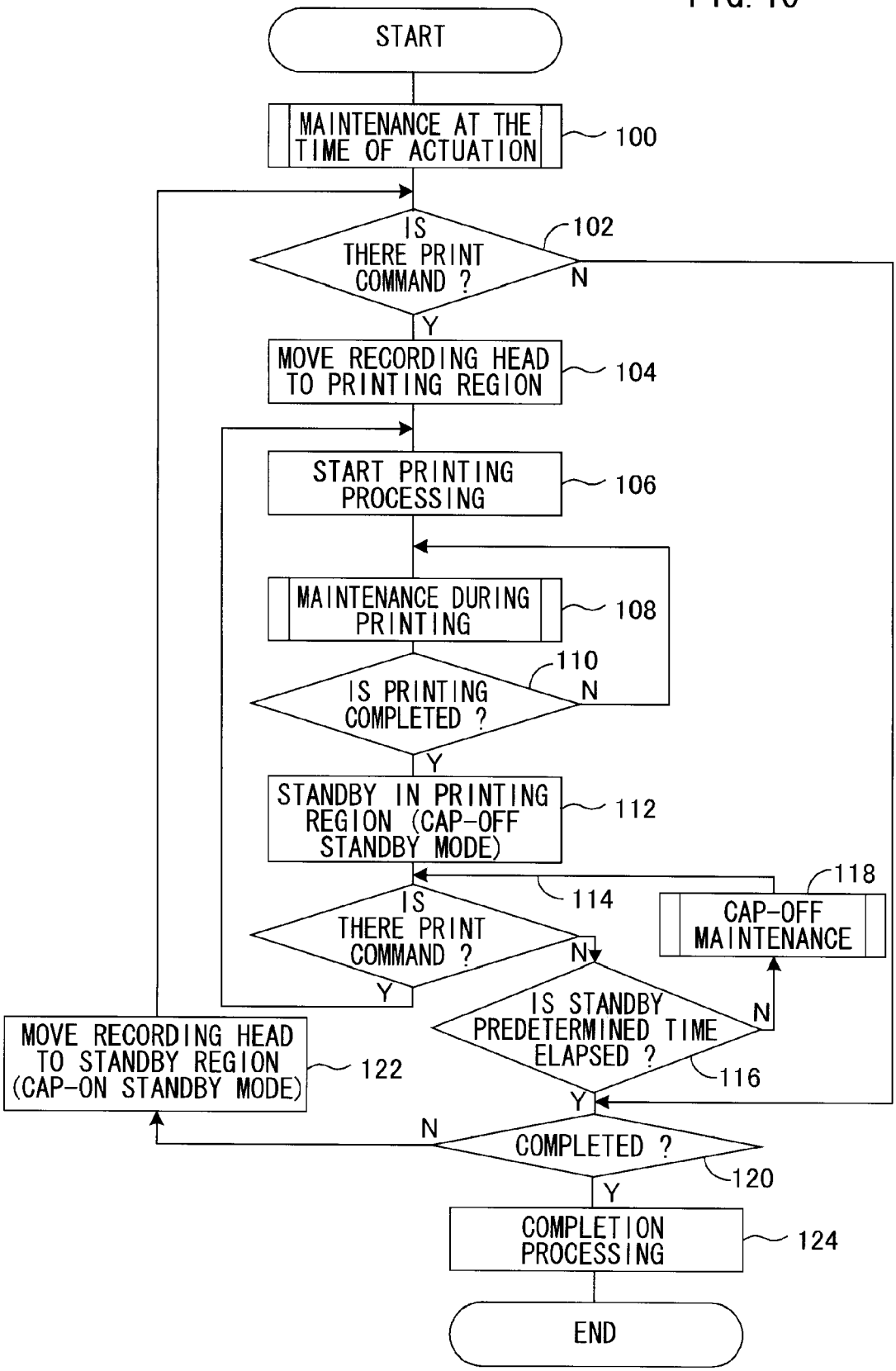
FIG. 10 is a flowchart showing a processing routine of a series of processing of a first exemplary embodiment.

Next, a processing routine of a series of processing in the first exemplary embodiment will be explained with reference to FIG. 10. This routine is started when a power source of the ink jet printer is turned ON.

In step 100, later-described maintenance processing is executed and then, in step 102, it is determined whether there is a print command. When image date which is output from outside information processing device connected through a network is received, the answer in step 102 is YES and the procedure is moved to step 104, and when the image data is not received, the procedure is moved to step 120.

In step 104, the recording head 70 is moved from the standby region to the printing region, and printing processing based on the received image data in step 106. Immediately after the processing is started in step 106, later-described maintenance processing during printing is executed in step 108.

Next, in step 110, it is determined whether the printing processing is completed or not. When the printing processing is completed, the procedure is moved to step 112, and when the printing processing is not completed, i.e., when the printing processing of received image data is not completed or when next image data is subsequently received, the procedure is returned to step 108.

In step 112, the recording head 70 is brought into the standby state in the printing region in a state where the printing processing is completed. The recording head 70 is not returned to the standby region and is ready for a case where next image data is received. Since the recording head 70 is in the standby state in the printing region, i.e., since the maintenance unit 78 in the standby region is not capped with the cap member 80, this state is called "cap-off standby mode".

Next, in step 114, it is determined whether there is a print command, and if there is a print command, the procedure is returned to step 106, and if there is no print command, the procedure is moved to step 116, and it is determined whether predetermined time is elapsed after the mode is brought into the cap-off standby mode. If the predetermined time is not elapsed, the procedure is moved to step 118, and later-described cap-off maintenance processing is executed.

If the predetermined time is elapsed after the mode is brought into the cap-off standby mode, the procedure is moved to step 120, and it is determined whether the processing should be completed. This determination is made based on whether a processing-completion signal generated when a power source-off button of the operation panel 29B is pressed is received. If the processing is not completed, the procedure is moved to step 122, the recording head 70 is moved to the standby region, and the recording head 70 is mounted on the maintenance unit 78. Since the recording head 70 is capped with the cap member 80 of the maintenance unit 78, this state is called "cap-on standby mode".

When the processing is to be completed, the procedure is moved to step 124, the recording head 70 is moved to the standby region, the completion processing, e.g., turning-off operation of the power source is carried out to complete the processing.

Next, a processing routine of measuring processing for measuring voltage-current phase difference which is executed in the later-described maintenance processing at the time of actuation, maintenance processing during printing, and cap-off maintenance processing will be explained.

In step 200, ink liquid is charged into the ink chamber 41 (see FIG. 1) from the ink cartridge. Next, in step 202, the charging operation of ink liquid is carried out until the entire liquid ejecting module 12 is normally filled with ink liquid by the processing such as suction.

Next, in step 204, voltage is applied to the piezoelectric element 48, and current at the piezoelectric element 48 at that time is measured (see FIG. 1). At that time, the current is measured while varying the frequency of the power source to be applied based on the above-described (processing 1 to be executed) (in this exemplary embodiment, in a range of 10000 Hz to 1010000 Hz, sampling frequency unit 2500 Hz). At that time, if such voltage that ink liquid is not ejected from the ejecting nozzle 40 is applied, it is possible to prevent ink liquid from being wasted at the time of measuring.

Next, in step 206, voltage-current phase difference is measured from the measured current, frequency-phase difference characteristics diagram as shown in FIG. 6 is prepared, the measuring result is stored in a memory (e.g., RAM31 or HDD 33) and the procedure is advanced to next step.

An arbitrary ejecting nozzle 40 may previously be determined as an ejecting nozzle 40 ("measuring nozzle", hereinafter) corresponding to the piezoelectric element 48 to which voltage is applied as a subject to be measured, the number of discharging operations may be counted for each ejecting nozzle 40, a condition that one of the ejecting nozzles 40 having the smallest number of discharging operations is measured is determined, and a nozzle to be measured may be specified, or all of the ejecting nozzles 40 may be measured.

The processing in steps 200 and 202 in this routine can be omitted when it is apparent that ink liquid is normally charged into the liquid ejecting module 12 such as during printing.

Figure 12:
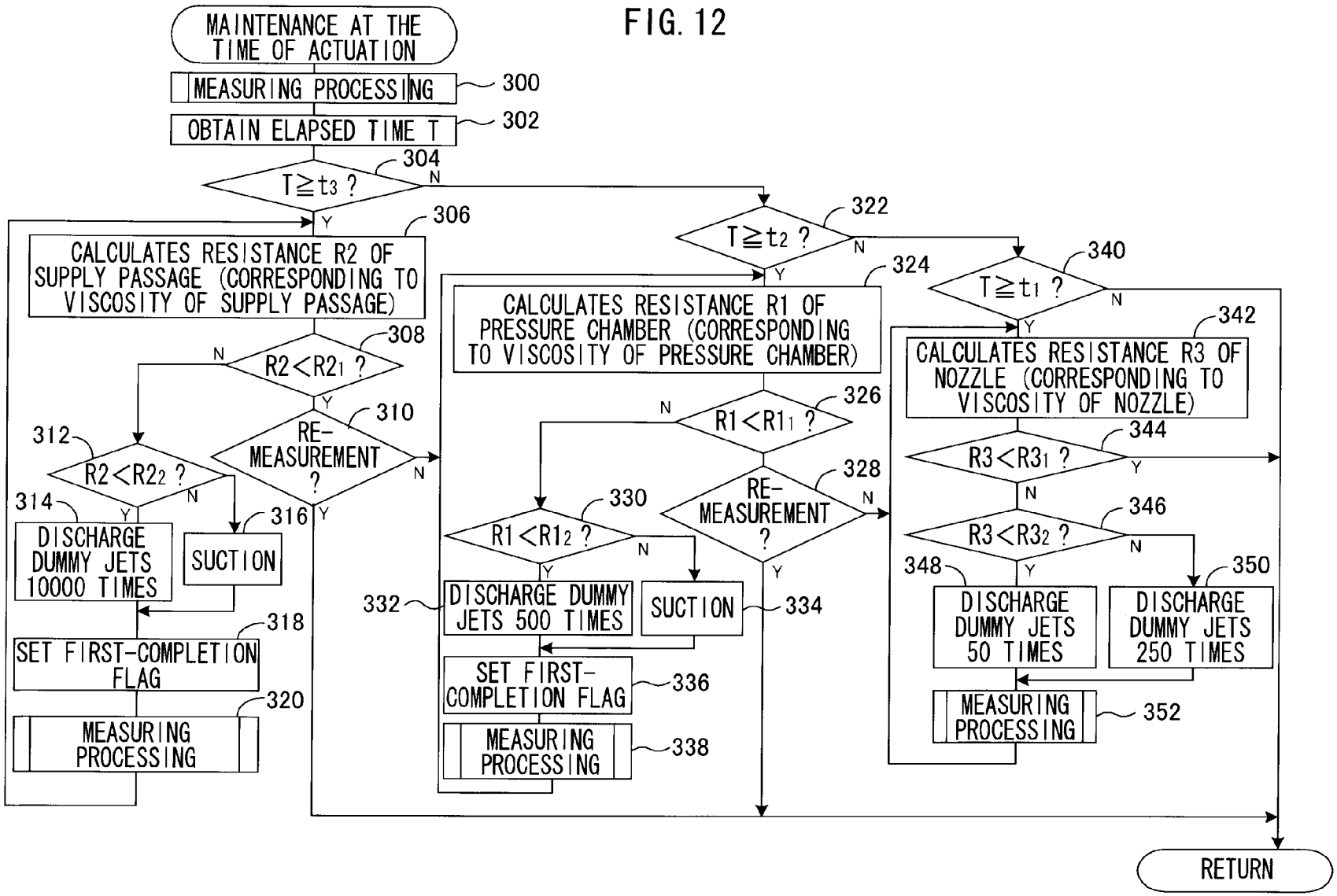
FIG. 12 is a flowchart showing a processing routine of maintenance processing at the time of actuation.

Next, a processing routine of the maintenance processing at the time of actuation which is executed in step 100 of a series of processing (FIG. 10) in the first exemplary embodiment will be explained with reference to FIG. 12. When this processing is executed, the recording head 70 is located in the standby region.

Figure 11:
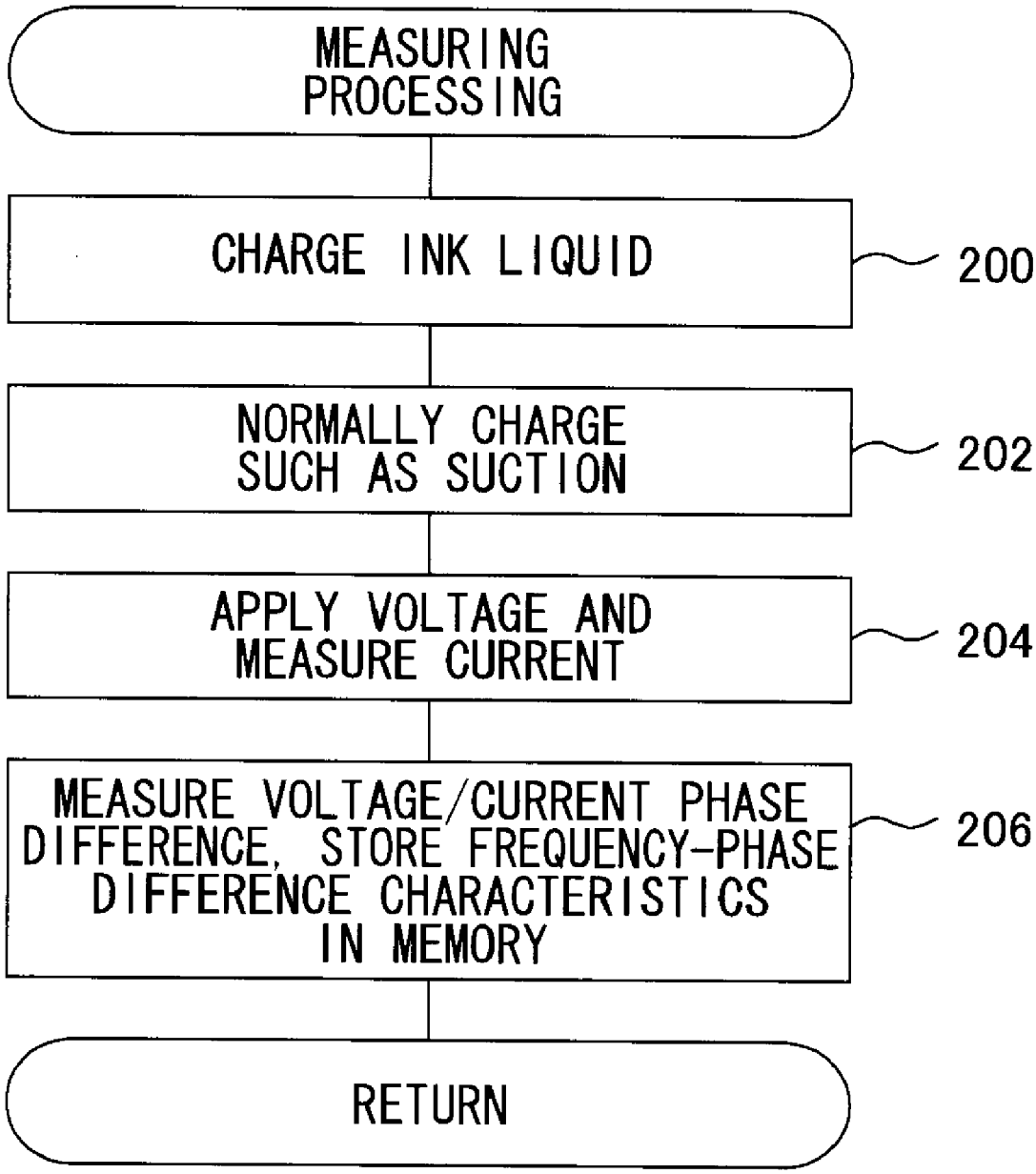
FIG. 11 is a flowchart showing a processing routine of measuring processing.

In step 300, the measuring processing (FIG. 11) is executed and then, in step 302, time T elapsed after the power source of the ink jet printer is turned OFF is obtained with reference to the counter.

Next, in step 304, it is determined whether the elapsed time T is equal to or longer than predetermined time $t_3$ (e.g., $t_3$=5 days). If T is equal to or longer than $t_3$, the procedure is moved to step 306, and if T is smaller than $t_3$, the procedure is moved to step 322.

Although it is determined whether T is equal to or longer than $t_3$ in this description, a look-up table (L. U. T) in which next processing corresponding to elapsed time T as shown in FIG. 13A may be determined is stored in the ROM 32 or the like, the procedure may be moved to later-described step 340 or the processing may be completed with reference to L. U. T of the elapsed time.

Viscosity of the ink liquid in the liquid ejecting module 12 starts increasing from the opened ejecting nozzle 40, and the viscosity is increased in the order of the pressure chamber 46 and the supply passage 44. Therefore, waste of measurement can be prevented by measuring in order of further location from the ejecting nozzle 40 which is the opening. In the L. U. T of the elapsed time shown in FIG. 13A, this fact is taken into account, and the measurement is carried out in order of further location from the ejecting nozzle 40.

In step 306, the resistance R2 of the supply passage is calculated by executing the curve fitting processing in the resonance position of the frequency-phase difference characteristics (processing 2 to be executed). More specifically, an approximate expression of a curve is calculated using an optimization algorithm in non-linearly minimum square principle such as simplex of a relation between the frequency and phase difference from the acoustic resistance based on the frequency-phase difference characteristics diagram measured in the measuring processing in step 300 and stored in a memory, the actually measured value of the relation between the frequency and phase difference and the identification value are compared with each other and the fitting is carried out.

Concerning the curve fitting, the processing is continuously carried out until a difference between the actually measured value and a theoretical value falls within a predetermined permissible value (threshold value). The fitting means to obtain a variable such that curves of the actually measured value and the theoretical value approaches each other, and square sum of the difference between the actually measured value and theoretical value is used for evaluation of the fitting.

Further, this evaluation method is called a norm (mathematical tool for giving a distance to a general vector space of conception of length of geometric vector in plane or space) used for quantification of vector difference, and as the norm is smaller, it is more fitting. Levenberg-marquardt algorithm is used for minimizing algorithm of the norm, and the square sum of the difference in the non-linear equation is minimized.

An example of the curve fitting processing will be explained concretely. As shown in FIG. 14, a total sum of square of the difference between the theoretically calculated value and all of the phase difference actually measured values is calculated from a relation of square of the difference between the phase difference actually measured value with respect to frequency and the theoretically calculated value, phase difference actually measured value and the theoretically calculated value. When the total sum becomes equal to or less than a predetermined threshold value, preferably when the total sum becomes minimum value, each variable is calculated.

To calculate the variables, "lsqrsolve" command of a software called "Scilab" is used. The lsqrsolve command of Scilab uses evenberg-marquardt algorithm, and carries out processing for minimizing the square sum of the difference in the non-linearly equation. The actually measured value, a theoretical equation, and an initial value of each variable are input by this command, the curve fitting is carried out, and a value of each variable when it most fits is calculated.

Figure 15:
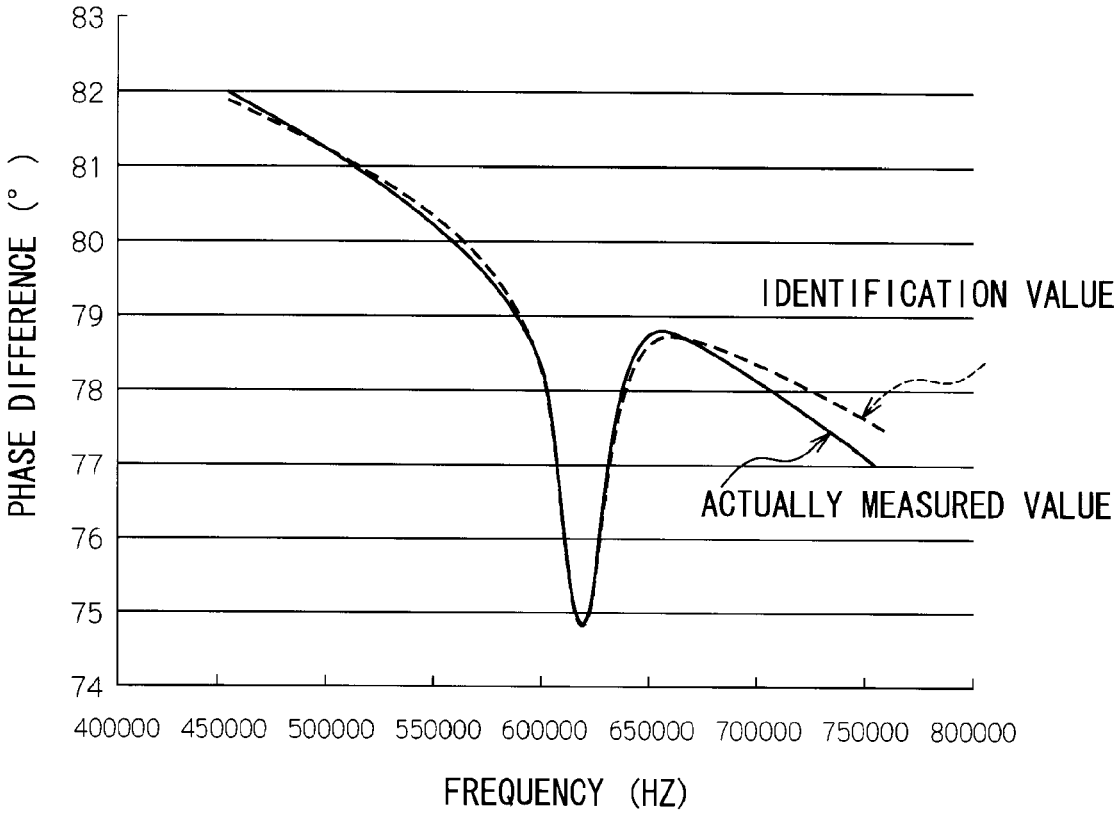
FIG. 15 is a diagram showing a high frequency-side fitting result.

As shown in FIG. 15, in a fitting result (actually measured value and identification value) in the waveform of the resonance region on the side of the high frequency region, piezoelectric element Cd, reactance L0, capacitance C0, resistance element R0, Rs, and constant td are given as constants, reactance L1=$3.0\times10^{-2}$ [H], capacitance C1=$2.2\times10^{-12}$[F], resistance R1=$4.0\times10^{3}$ [Ω], and the fitting condition is a default value (initial value) of Scilab.

As shown in the actually measured value and fitting waveform of the identification value in FIG. 15, the fitting in the waveform of resonance region on the side of the high frequency region based on the equivalent circuit 700 in FIG. 8 is carried out using a theoretical equation (electromagnetically, an equation for obtaining a phase difference generally, and this is previously stored in Scilab) used for identification of reactance L1, capacitance C1 and resistance R1 of the equivalent circuit in FIG. 7.

Figure 16:
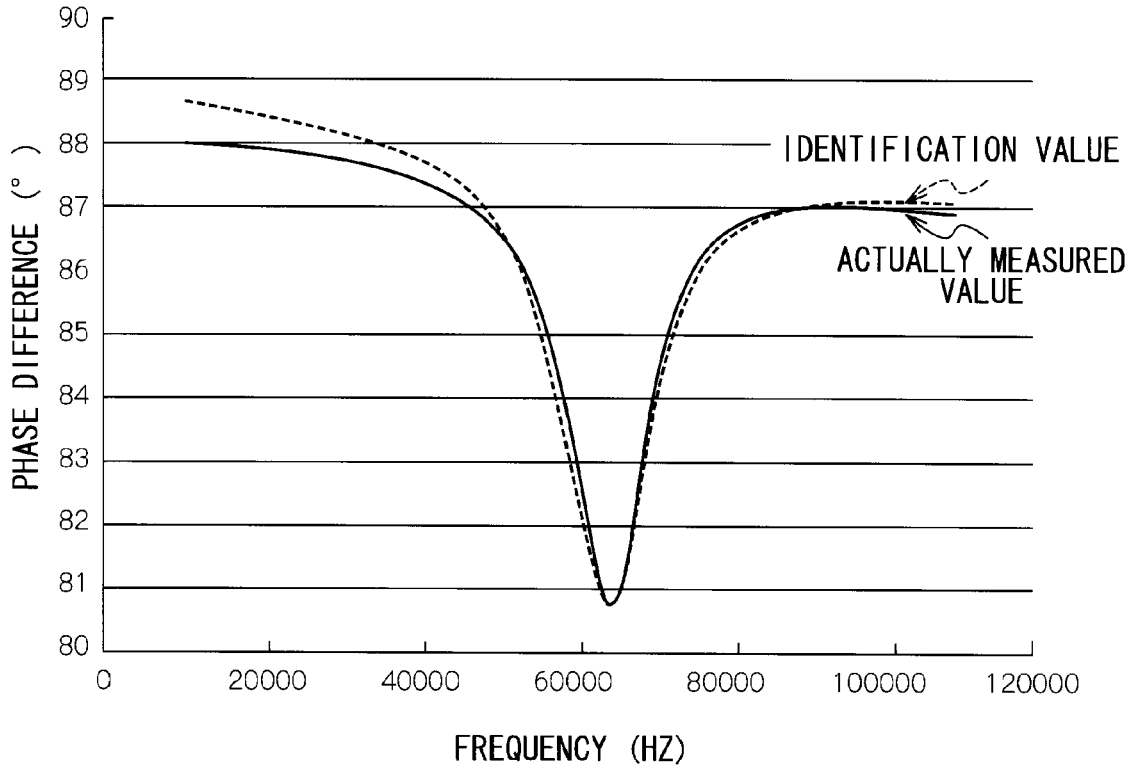
FIG. 16 is a diagram showing a low frequency-side fitting result.

Similarly, fitting in the waveform of the resonance region on the side of the low frequency region is carried out. As shown in FIG. 16, a low frequency-side fitting result (actually measured value and identification value) obtains L2, R2, L3 and R3 by making the reactance L1, capacitance C1 and resistance R1 as values calculated under high frequency region side resonance region using the piezoelectric element Cd, reactance L0, capacitance C0, resistance R0, Rs and constant td as constants.

Next, in step 308, it is determined whether resistance R2 of the supply passage is less than a predetermined value $R2_1$. As can be found from the equations (1) and (2), since the resistance R is in a linear relation with viscosity η, a viscosity increasing degree of ink liquid is determined through resistance R. Therefore, a value corresponding to viscosity η is determined as the predetermined value $R2_1$. If R2 is less than $R2_1$, the procedure is moved to step 310, and when R2 is equal to or greater than $R2_1$, the procedure is moved to step 312.

Although it is determined whether R2 is less than $R2_1$ in the above description, L. U. T in which next processing corresponding to a value of R2 as shown in FIG. 13B may be stored in the ROM 32, and the procedure may be moved directly to step 314, step 316 and step 324 with reference to L. U. T when R2 is calculated, or the procedure may be completed. In L. U. T when R2 shown in FIG. 13B is calculated, the resistance R and viscosity η correspond to each other, and the column of "corresponding viscosity" is provided to explain that the processing contents are determined in correspondence with the viscosity η, but since it is only necessary that a corresponding relation between the resistance R and the next processing can be grasped in the actual L. U. T, it is unnecessary to determine a column of "corresponding viscosity".

In step 310, it is determined whether R2 which is calculated in the current time is based on the first measurement or based on re-measurement. This processing is carried out with reference to a flag which is set during the processing in later-described step 318. In the case of the re-measurement, returning is carried out, and it is not the re-measurement, the procedure is moved to step 324.

When R2 is equal to or greater than $R2_1$ and the procedure is moved to step 312, it is determined whether resistance R2 of the supply passage is less than a predetermined value $R2_2$ which is predetermined in correspondence with viscosity η. When R2 is less than $R2_2$, the procedure is moved to step 314, dummy jet (preliminary ejection) is ejected 10000 times. The dummy jet means discharging ink liquid onto a sheet-conveying belt, an ink receiver or the cap member 80 of the maintenance unit 78 irrespective of printing (ejection) based on image data.

When R2 is equal to or greater than $R2_2$, the procedure is moved to step 316, and suction maintenance is carried out. In the suction maintenance, the recording head 70 is attached to the maintenance unit 78, the ejecting nozzles 40 are capped with the cap member 80 and in this state, ink liquid in the liquid ejecting module 12 is sucked by suction of a suction pump provided in the cap member 80, and ink liquid whose viscosity is increased is ejected.

Since all of the ejecting nozzles 40 basically increase the viscosity similarly, all of the ejecting nozzles 40 can be ejecting nozzles 40 ("maintenance carrying out nozzles", hereinafter) for which maintenance is carried out. Since there is a possibility that tendencies of viscosity increase are different from each other depending upon disposition positions of the ejecting nozzles 40 in the liquid ejecting module 12, areas of the ejecting nozzles 40 are classified on the disposition position basis at the time of shipment, the tendency of each area is checked and previously stored, and when the processing of the exemplary embodiment is carried out, the measurement nozzle is set in each area and measurement is carried out, and maintenance may be performed in each area based on the result. When all of the ejecting nozzles 40 are measurement nozzles, the maintenance may be performed for each ejecting nozzle 40.

Next, in step 318, a first time completion flag indicating that maintenance based on first measurement is completed is set, and measurement is again carried out in step 320, and the procedure is returned to step 306.

When the elapsed time T is less than $t_3$ and the procedure is moved to step 322, it is determined whether the elapsed time T is equal to or longer than predetermined time $t_2$ ($t_2$=12 hours for example). When T is equal to or longer than $t_2$, the procedure is moved to step 324, and when T is smaller than $t_2$, the procedure is moved to step 340.

In step 324, resistance R1 of the pressure chamber is calculated by the same processing as that in step 306.

Next, in step 326, it is determined whether resistance R1 of the pressure chamber is less than predetermined value R11. A value corresponding to viscosity η is determined as the predetermined value R11. When R1 is less than R11, the procedure is moved to step 328, and when R1 is equal to or greater than R11, the procedure is moved to step 330.

Although it is determined whether R1 is less than R11 in this description, L. U. T in which next processing corresponding to the R1 value as shown in FIG. 13C is determined may be stored in the R32 or the like, and the procedure may be moved directly to step 332, step 334 and step 342 with reference to L. U. T when R1 is calculated, or the procedure may be completed.

In step 328, it is determined whether R1 which was calculated at current time is based on re-measurement. If R1 is based on the re-measurement, the procedure is returned, and if R1 is not based on the re-measurement, the procedure is moved to step 342.

When R1 is equal to or greater than R11 and the procedure is moved to step 330, it is determined whether resistance R1 of the pressure chamber is less than predetermined value R12 which is predetermined in correspondence with viscosity η. When R1 is less than R12, the procedure is moved to step 332, dummy jet is ejected 500 times, and when R1 is equal to or greater than R12, the procedure is moved to step 334, and the suction maintenance is carried out.

Next, in step 336, a first-completion flag is set and then, in step 338, the re-measurement processing is executed and the procedure is returned to step 324.

If elapsed time T is less than $t_2$ and the procedure is moved to step 340, it is determined whether the elapsed time T is equal to or longer than predetermined time $t_1$ (e.g., $t_1$=10 minutes). If T is equal to or longer than t1, the procedure is moved to step 342, and when T is smaller than $t_1$, the procedure is returned.

In step 342, resistance R3 of the ejecting nozzle is calculated through the same processing as that in step 306.

Next, in step 344, it is determined whether the resistance R3 of the ejecting nozzle is less than a predetermined value $R3_1$. A value corresponding to viscosity η is determined as the predetermined value $R3_1$. If R3 is less than $R3_1$, the procedure is returned, and if R3 is equal to or greater than $R3_1$, the procedure is moved to step 346.

Although it is determined whether R3 is less than $R3_1$ in this description, L. U. T in which next processing corresponding to R3 value as shown in FIG. 13D may be stored in the R32 or the like, the procedure may be moved directly to later-described step 350 with reference to the L. U. T at the time of calculation of R3 and the processing may be completed.

In step 346, it is determined whether resistance R3 of the ejecting nozzle is less than predetermined value $R3_2$ which is predetermined in correspondence with viscosity η. When R3 is less than $R3_2$, the procedure is moved to step 348, dummy jet is ejected 50 times, and if R3 is equal to or greater than $R3_2$, the procedure is moved to step 350 and dummy jet is ejected 250 times.

Next, in step 352, re-measurement processing is executed and the procedure is returned to step 342.

In the processing of steps 342 to 352 in which maintenance is carried out based on resistance R3 of the ejecting nozzle, the processing is completed when R3 is less than $R3_1$ irrespective of based on the first measurement or based on re-measurement. Therefore, determining processing in which a first-completion flag is set and it is determined whether the measurement is re-measurement is omitted.

Figure 17:
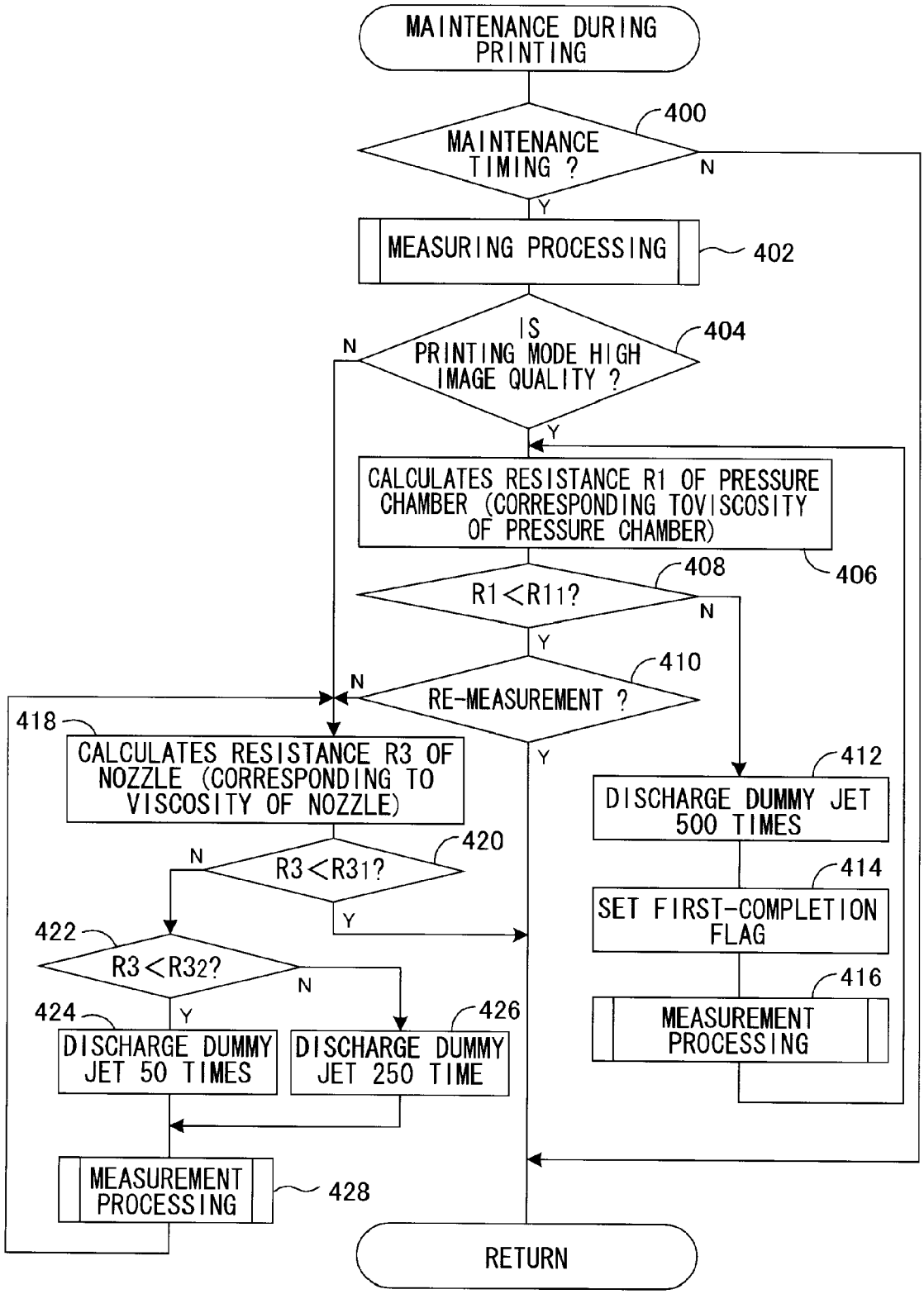
FIG. 17 is a flowchart showing a processing routine of maintenance processing during printing.

Next, a processing routine of maintenance processing during printing which is executed in step 108 of a series of processing (FIG. 10) in the first exemplary embodiment will be explained with reference to FIG. 17. When this processing is to be executed, the recording head 70 is located at the printing region, and the printing processing is being executed.

In step 400, it is determined whether it is maintenance timing. This determination is made in such a manner that predetermined time interval is previously determined, time between a print job immediately after predetermined time is elapsed and a print job is determined as the maintenance timing. Time at which a predetermined number of sheets passes may be determined as the maintenance timing. When it is the maintenance timing, the procedure is moved to step 402, and when it is not the maintenance timing, the procedure is returned.

In step 402, the measurement processing (FIG. 11) is executed and then, in step 404, it is determined whether the print mode is set to a high image quality mode or to a standard mode. When the print mode is set to the high image quality mode, this determination is for carrying out more precise maintenance than that of the standard mode. The print mode is determined by obtaining information selected from the operation panel 29B of the ink jet printer by a user, or by a kind of set sheets, for example, when glossy print sheets are set, it is determined that the print mode is the high image quality mode. In the case of the high image quality mode, the procedure is moved to step 406, and in the case of the standard mode, the procedure is moved to step 418.

In step 406, resistance R1 of the pressure chamber is calculated through the same processing as that in step 306 of the maintenance processing (FIG. 12) at the time of actuation.

Next, in step 408, it is determined whether resistance R1 of the pressure chamber is less than predetermined value R11. A value corresponding to viscosity η is determined as the predetermined value R11. When R1 is less than R11, procedure is moved to step 410, and when R1 is equal to or greater than R11, procedure is moved to step 412. Although it is determined whether R1 is less than R11 in this description, L. U. T in which next processing corresponding to R1 value as shown in FIG. 13C may be stored in the R32 or the like, the procedure may be moved directly to later-described step 412 and step 418 with reference to the L. U. T at the time of calculation of R1 and the processing may be completed.

In step 410, it is determined whether R1 calculated this time is based on re-measurement. If R1 is based on the re-measurement, the procedure is returned, and if R1 is not based on the re-measurement, procedure is moved to step 418.

When R1 is equal to or greater than R11 and the procedure is moved to step 412, dummy jet is ejected 500 times, a first-completion flag is set in step 414 and then, in step 416, voltage-current phase difference is measured again and the procedure is returned to step 406.

This routine is executed during printing, and the suction maintenance can not be carried out. Therefore, when L. U. T at the time of calculation of R1 in FIG. 13C is referred to in step 408, even if R1 is equal to or greater than R12, ejecting operation of dummy jet of 500 times determined when R1 is less than R11 to R12 is carried out.

When the print mode is the standard mode, or when R1 is less than $R2_1$ and the procedure is moved to step 418, resistance R3 of the ejecting nozzle is calculated through the same processing as that in step 306 of the maintenance processing (FIG. 12) at the time of actuation.

Next, in step 420, it is determined whether resistance R3 of the ejecting nozzle is less than a predetermined value $R3_1$. A value corresponding to viscosity η is determined as the predetermined value $R3_1$. When R3 is less than $R3_1$, the procedure is returned, and when R3 is equal to or greater than $R3_1$, the procedure is moved to step 422. Although it is determined whether R3 is less than $R3_1$ in this description, L. U. T in which next processing corresponding to R3 value as shown in FIG. 13D may be stored in the $R3_2$ or the like, the procedure may be moved directly to later-described step 424 and step 426 with reference to the L. U. T at the time of calculation of R3 and the processing may be completed.

In step 422, it is determined whether resistance R3 of the ejecting nozzle is less than a predetermined value $R3_2$ which is predetermined in correspondence with viscosity η. When R3 is less than $R3_2$, procedure is moved to step 424 and dummy jet is ejected 50 times, and when R3 is equal to or greater than $R3_2$, the procedure is moved to step 426 and dummy jet is ejected 250 times.

Next, in step 428, re-measurement processing is carried out, and the procedure is returned to step 418.

Figure 18:
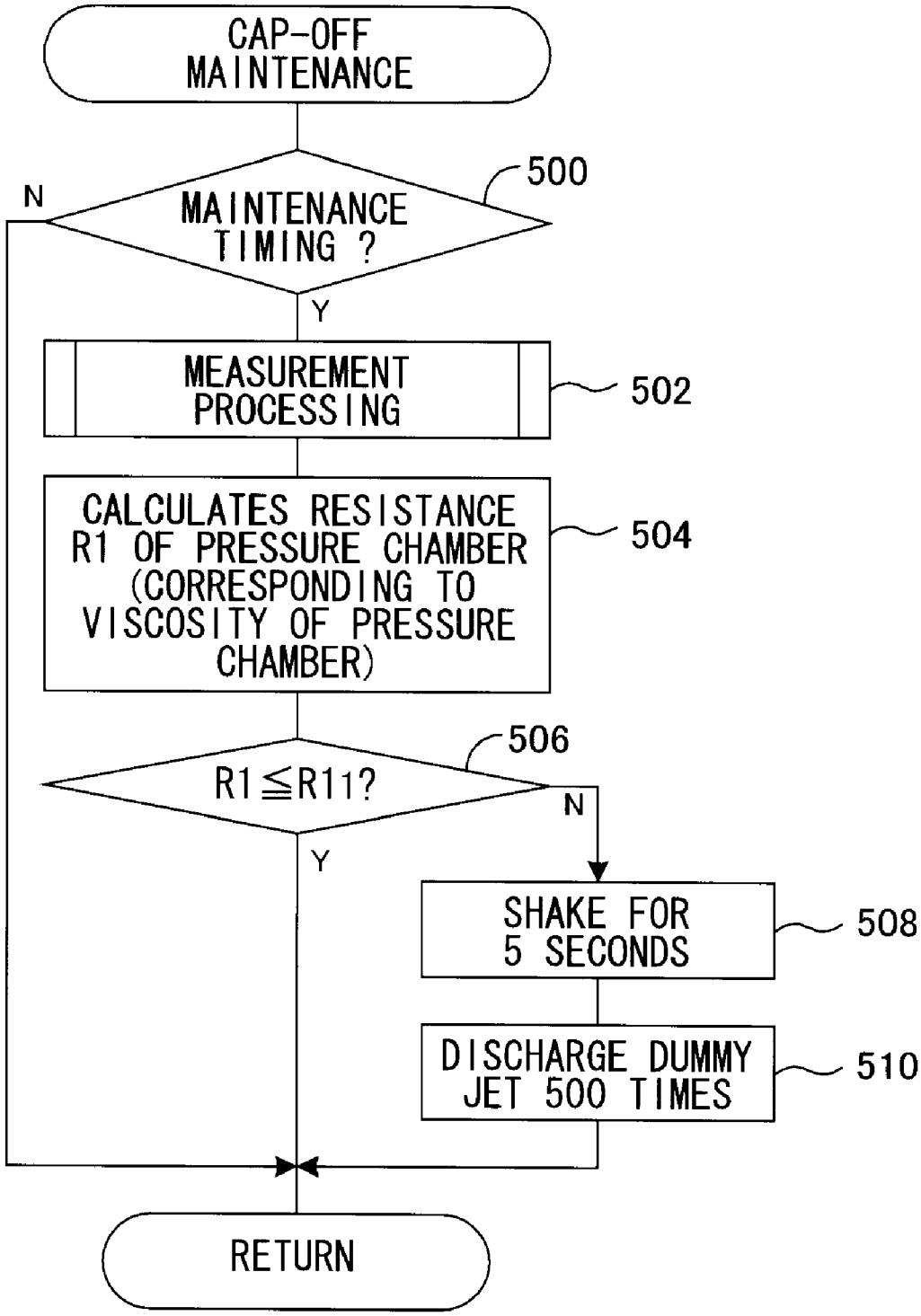
FIG. 18 is a flowchart showing a processing routine of cap off maintenance processing.

Next, a processing routine of the cap-off maintenance processing executed in step 118 in a series of processing (FIG. 10) in the first exemplary embodiment will be explained with reference to FIG. 18. When this processing is executed, the recording head 70 is located in the printing region, and the mode in the cap-off standby mode.

In step 500, it is determined whether it is a maintenance timing. This determination is made based on whether predetermined time is elapsed. This predetermined time is shorter than standby time in the cap-off standby mode determined in step 116 of the series of processing (FIG. 10). When it is the maintenance timing, the procedure is moved to step 502, and when it is not the maintenance timing, the procedure is returned.

In step 502, the measuring processing (FIG. 11) is executed and then, in step 504, the resistance R1 of the pressure chamber is calculated through the same processing as that in step 306 of the maintenance processing (FIG. 12) at the time of actuation.

Next, in step 506, it is determined whether resistance R1 of the pressure chamber is less than a predetermined value $R1_1$. A value corresponding to viscosity η is determined as the predetermined value $R1_1$. When R1 is less than $R1_1$, the procedure is returned, and when R1 is equal to or greater than $R1_1$, the procedure is moved to step 508.

In step 508, ink liquid in the pressure chamber 46 is shaken for 5 seconds. More specifically, voltage of such a degree that ink liquid is not ejected from the ejecting nozzles 40 is applied to the piezoelectric element 48, thereby shaking the ink liquid. This is processing for preventing viscosity from increasing by stirring the ink liquid in the pressure chamber 46.

Next, in step 510, dummy jet is ejected 500 times and the procedure is returned.

As explained above, according to the ink jet printer of the first exemplary embodiment, it is possible to perform the maintenance corresponding to viscosities of the supply passage, the pressure chamber and the ejecting nozzle of the liquid ejecting module. Therefore, it is possible to perform the maintenance for lowering the viscosity of ink liquid without discharging ink liquid wastefully.

Next, a second exemplary embodiment will be explained. In the first exemplary embodiment, measuring processing is carried out at every maintenance timing during the printing maintenance, and maintenance is carried out based on the measuring result. In the second exemplary embodiment is different from the first exemplary embodiment in that the measurement processing is carried out previously before printing, and the maintenance contents are determined. A structure of the ink jet printer of the second exemplary embodiment is the same as that of the ink jet printer of the first exemplary embodiment, explanation thereof will be omitted.

Figure 19:
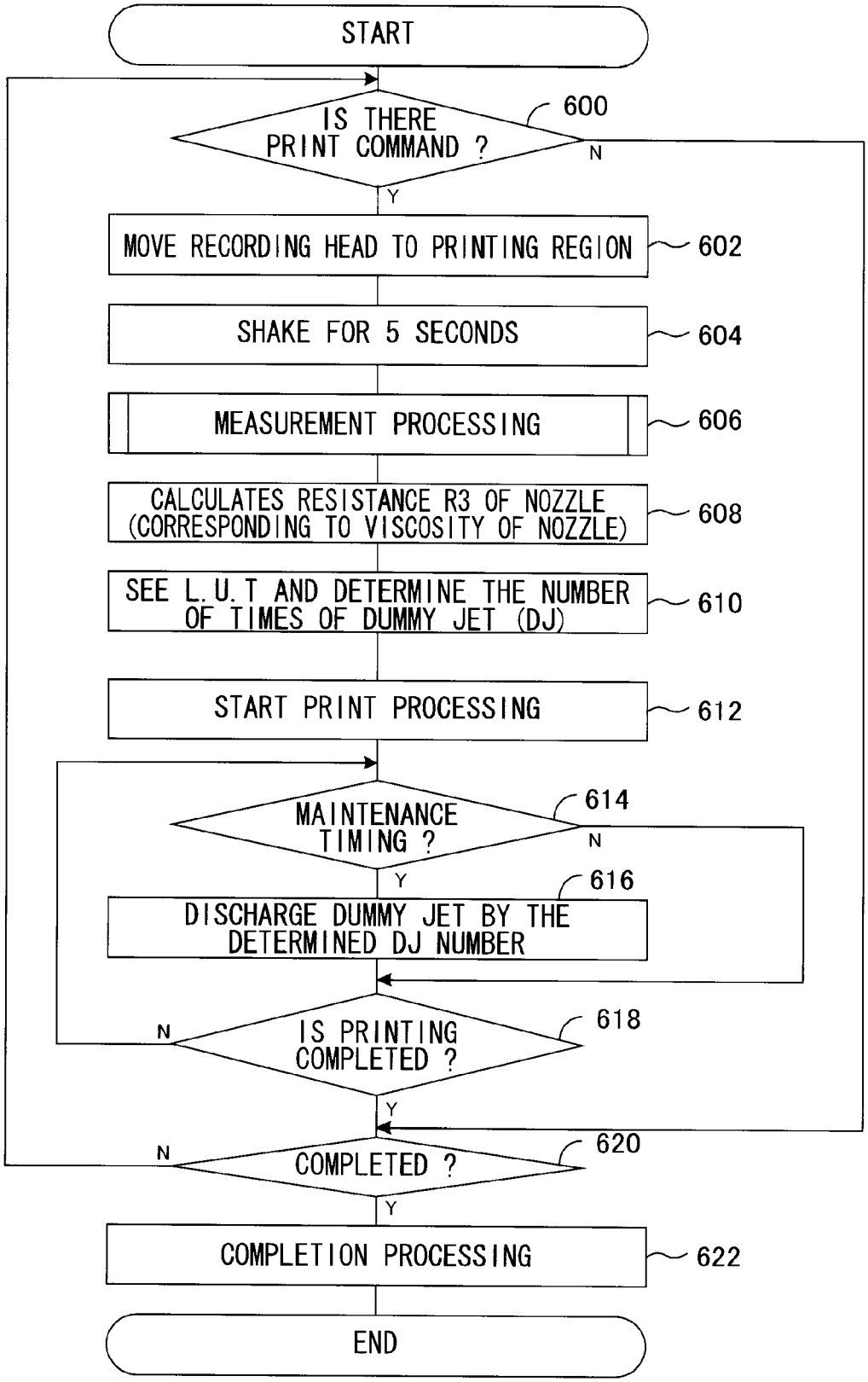
FIG. 19 is a flowchart showing a processing routine of a series of processing in a second exemplary embodiment.

A processing routine of a series of processing in the second exemplary embodiment will be explained with reference to FIG. 19. This routine is started when a power source of the ink jet printer is turned ON.

In step 600, it is determined whether there is a print command. When image data which is output from external information processing apparatus connected through a network is received, the procedure is moved to step 602, and the image data is not received, the procedure is moved to step 620.

In step 602, the recording head 70 is moved from the standby region to the printing region, and immediately after the recording head 70 starts moving, ink liquid in the pressure chamber 46 is shaken for 5 seconds in next step 604. More specifically, voltage of such a degree that ink liquid is not ejected from the ejecting nozzles 40 is applied to the piezoelectric element 48, thereby shaking the ink liquid.

Next, in step 606, the measuring processing is carried out in the same manner as that of the measuring processing (FIG. 10) in the first exemplary embodiment. Next, in step 608, resistance R3 of the ejecting nozzle is calculated through the same processing as that in step 306 of the maintenance processing (FIG. 12) at the time of actuation in the first exemplary embodiment.

Next, in step 610, the number of dummy jet (DJ number) at the time of maintenance is determined with reference to L. U. T in which the number of dummy jet corresponding to resistance R3 value as shown in FIG. 20 previously stored in the R32 or the like.

Next, in step 612, the printing processing is started and then, in step 614, it is determined whether it is maintenance timing. This determination is made in such a manner that predetermined time interval is previously determined, time between a print job immediately after predetermined time is elapsed and a print job is determined as the maintenance timing. Time at which a predetermined number of sheets passes may be determined as the maintenance timing. When it is the maintenance timing, the procedure is moved to step 616, and dummy jet is ejected by the DJ number determined in step 610, and the procedure is moved to step 618.

When it is not the maintenance timing, the procedure is moved to step 618 as it is, and it is determined whether the printing processing is completed. When the printing processing is completed, the procedure is moved to step 620, and when the printing processing of received image data is not completed or when image data is subsequently received and the printing processing is not completed, the procedure is returned step 614.

In step 620, it is determined whether the processing should be completed. This determination is made whether a processing-completion signal which is generated when a power source OFF button of the operation panel 29B is pressed is received. When the processing should not be completed, the procedure is returned step 600, and when the processing should be completed, the procedure is moved to step 622, the completion processing is carried out by moving the recording head 70 to the standby region to turn off the power source, and the processing is completed.

As explained above, according to the ink jet printer of the second exemplary embodiment, concerning the maintenance processing during printing, the processing can be simplified as compared with a case where the measuring processing is carried out at every maintenance timing.

In the second exemplary embodiment also, like the first exemplary embodiment, maintenance at the time of actuation and cap-off maintenance processing may be carried out at the same time.

In the second exemplary embodiment, the number of dummy jets is determined based on the measurement result, but predetermined time for determining the maintenance timing may be determined, or condition such as selection of measuring nozzles or maintenance nozzles may be determined.

Although the voltage-current phase difference is measured in the first and second exemplary embodiments, admittance may be measured for identification instead of the phase difference.

Although the first and second exemplary embodiments have been described based on the head using the piezoelectric element, i.e., the piezo ink jet head, even if TIJ (Thermal Ink Jet) head (thermal ink jet liquid ejecting module) is used as the liquid ejecting module, the same effect can be obtained. As a measuring method in the case of the thermal ink jet printer, a piezoelectric element is put in a flow passage and an admittance measuring system is installed. More specifically, in the case of the thermal ink jet printer, the piezoelectric element, or a diaphragm which vibrates in association with the piezoelectric element is formed as a portion of a flow passage wall and through which liquid flows, and a ratio of current and voltage at that time and phase difference are measured. A sine wave (rectangular wave or triangular wave) is applied to the piezoelectric element (it is unnecessary that liquid surface swings), and voltage/current phase difference is measured at every applied frequency at that time.

In the first and second exemplary embodiments, curve fitting is carried out from frequency-phase difference characteristics and resistance is calculated. Alternatively, frequency at which phase difference becomes a peak value may be specified from the measured frequency-phase difference characteristics, and resistance may be calculated from the first equivalent circuit under this frequency. Further, frequency for calculating resistance may be predetermined, and resistance may be calculated from voltage-current phase difference when voltage of that frequency is applied.

Although resistance is calculated in the first and second exemplary embodiments, viscosity may be calculated based on the equations (1) and (7) from the calculated resistance.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid droplet ejecting apparatus comprising:

a liquid ejecting module that includes a pressure chamber that has a piezoelectric element and an ejecting nozzle, and a supply passage that supplies liquid into the pressure chamber, the liquid ejecting module configured to eject, from the ejecting nozzles, liquid which is supplied to the pressure chamber through the supply passage;

a measurement section that measures a phase difference between a voltage applied to the piezoelectric element and a current through the liquid ejecting module when the voltage is applied, in order to measure fluid viscosity of the liquid in the liquid ejecting module;

a resistance calculation section that calculates, based on the phase difference measured by the measurement section, one resistance in a first equivalent circuit that represents electrical characteristics of the liquid ejecting module and that includes a plurality of resistances including a resistance of the supply passage, a resistance of the pressure chamber and a resistance of the ejecting nozzle; and a processing section that performs processing for lowering and adjusting fluid viscosity in the liquid ejecting module based on the one resistance calculated by the resistance calculation section, wherein the processing section performs a process selected from the following processes: preliminarily ejecting the liquid in the liquid ejecting module, pressurizing the liquid in the liquid ejecting module, and pushing the liquid out or applying suction to the liquid, when the liquid droplet electing apparatus is started, the resistance calculation section calculates a resistance of the supply passage, and if the calculated resistance value of the supply passage is greater than a first predetermined value, the calculated resistance of the supply passage is the one resistance, if the calculated resistance value of the supply passage is less than the first predetermined value, a resistance of the pressure chamber is calculated, and if the calculated resistance value of the pressure chamber is greater than a second predetermined value, the calculated resistance of the pressure chamber is the one resistance, if the calculated resistance value of the pressure chamber is less than the second predetermined value, the resistance of the ejecting nozzle is the one resistance; and the processing section performs the process using the amount of the liquid preliminarily ejected or suctioned so as to satisfy the following equation:

$$v1<v2<v3,$$

wherein v1 represents the amount of liquid when the resistance calculated as the one resistance by the resistance calculation section is the resistance of the supply passage, v2 represents the amount of liquid when the resistance calculated as the one resistance by the resistance calculation section is the resistance of the pressure chamber, and v3 represents the amount of liquid when the resistance calculated as the one resistance by the resistance calculation section is the resistance of the ejecting nozzle.

2. The liquid droplet ejecting apparatus according to claim 1, wherein the plurality of resistances respectively correspond to a plurality of acoustic resistances that form a second equivalent circuit, the plurality of acoustic resistances represent acoustic characteristics of the liquid ejecting module, and that are determined in accordance with respective levels of fluid viscosity in the supply passage, the pressure chamber, and the ejecting nozzle.

3. The liquid droplet ejecting apparatus according to claim 1, wherein the resistance calculation section calculates the one resistance as a resistance in which a total sum of square of a difference between a measured value and a theoretical value is equal to or less than a predetermined threshold value, the measured value represents a phase difference of respective frequencies measured by the measurement section when a plurality of voltages each having a different frequency are applied, and the theoretical value represents a theoretical phase difference of respective frequencies that correspond to a plurality of frequencies which are determined based on the first equivalent circuit.

4. The liquid droplet ejecting apparatus according to claim 1, wherein the resistance calculation section calculates the one resistance using a phase difference that is a peak value.

5. The liquid droplet ejecting apparatus according to claim 1, wherein the resistance calculation section calculates the one resistance while a voltage of a predetermined frequency is applied.

6. The liquid droplet ejecting apparatus according to claim 2, wherein the acoustic resistance, which is determined in accordance with a level of fluid viscosity in the ejecting nozzle in the second equivalent circuit and which corresponds to the resistance calculated by the resistance calculation section, is expressed by the following equation:

$$r=\frac{128\times\eta}{\pi}\times\int_0^{l}\frac{1}{\frac{D2-D1}{le}-D1}dx$$

$$=\frac{128\times\eta\times le}{\pi}\times\frac{D1^2+D1\times D2+D2^2}{3\times D1^3\times D2^3}$$

wherein r represents an acoustic resistance of the ejecting nozzle, η represents a fluid viscosity in the ejecting nozzle, D1 represents a minimum cross section diameter of a flow passage of the ejecting nozzle, D2 represents a maximum cross section diameter of the flow passage of the ejecting nozzle, and le represents a length of the flow passage.

7. The liquid droplet ejecting apparatus according to claim 1, wherein during printing, the resistance calculation section calculates a resistance of the pressure chamber as the one resistance if a resistance value of the pressure chamber is greater than a third predetermined value, the resistance calculation section calculates a resistance of the ejecting nozzle as the one resistance if a resistance value of the pressure chamber is smaller than the third predetermined value, and the processing section performs the process using the amount of the liquid preliminarily ejected or suctioned so as to satisfy the following equation:

$$v4<v5,$$

wherein v4 represents the amount of liquid when the resistance calculated as the one resistance by the resistance calculation section is the resistance of the pressure chamber, and v5 represents the amount of liquid when the resistance calculated as the one resistance by the resistance calculation section is the resistance of the ejecting nozzle.

8. The liquid droplet ejecting apparatus according to claim 1, wherein the resistance calculation section calculates the resistance before printing, and the processing section determines, before printing, the amount of liquid preliminarily ejected or suctioned during printing, based on the resistance calculated by the resistance calculation section.

9. The liquid droplet ejecting apparatus according to claim 1, wherein the measurement section remeasures the phase difference after the processing has been performed by the processing section.

10. A liquid droplet ejecting method comprising:

ejecting liquid that is supplied to a pressure chamber through a supply passage from ejecting nozzles;

measuring a phase difference between a voltage applied to a piezoelectric element and a current through a liquid ejecting module when the voltage is applied, in order to measure fluid viscosity of the liquid in the liquid ejecting module;

calculating, based on the phase difference measured by the measurement section, one resistance in a first equivalent circuit that represents electrical characteristics of the liquid ejecting module and that includes a plurality of resistances including a resistance of the supply passage, a resistance of the pressure chamber and a resistance of the ejecting nozzle;

performing processing for lowering and adjusting fluid viscosity in the liquid electing module based on the calculated one resistance, the processing being selected from the following processes: preliminarily ejecting the liquid in the liquid electing module, pressurizing the liquid in the liquid electing module, and pushing the liquid out or applying suction to the liquid;

when the liquid droplet ejecting apparatus is started, calculating a resistance of the supply passage, and if the calculated resistance value of the supply passage is greater than a first predetermined value, the calculated resistance of the supply passage is the one resistance;

if the calculated resistance value of the supply passage is less than the first predetermined value, calculating a resistance of the pressure chamber, and if the calculated resistance value of the pressure chamber is greater than a second predetermined value, the calculated resistance of the pressure chamber is the one resistance;

if the calculated resistance value of the pressure chamber is less than the second predetermined value, the resistance of the electing nozzle is the one resistance; and performing the processing using the amount of the liquid preliminarily elected or suctioned so as to satisfy the following equation:

$$v1<v2<v3,$$

wherein v1 represents the amount of liquid when the resistance calculated as the one resistance is the resistance of the supply passage, v2 represents the amount of liquid when the resistance calculated as the one resistance is the resistance of the pressure chamber, and v3 represents the amount of liquid when the resistance calculated as the one resistance is the resistance of the ejecting nozzle.

11. A computer readable medium storing a program causing a computer to execute a process for image processing, the process comprising:

ejecting liquid that is supplied to a pressure chamber through a supply passage from ejecting nozzles;

measuring a phase difference between a voltage applied to a piezoelectric element and a current through a liquid ejecting module when the voltage is applied, in order to measure fluid viscosity of the liquid in the liquid ejecting module;

calculating, based on the phase difference measured by the measurement section, one resistance in a first equivalent circuit that represents electrical characteristics of the liquid electing module and that includes a plurality of resistances including a resistance of the supply passage, a resistance of the pressure chamber and a resistance of the electing nozzle;

performing processing for lowering and adjusting fluid viscosity in the liquid electing module based on the calculated one resistance, the processing being selected from the following processes: preliminarily electing the liquid in the liquid ejecting module, pressurizing the liquid in the liquid ejecting module, and pushing the liquid out or applying suction to the liquid;

when the liquid droplet electing apparatus is started, calculating a resistance of the supply passage, and if the calculated resistance value of the supply passage is greater than a first predetermined value, the calculated resistance of the supply passage is the one resistance;

if the calculated resistance value of the supply passage is less than the first predetermined value, calculating a resistance of the pressure chamber, and if the calculated resistance value of the pressure chamber is greater than a second predetermined value, the calculated resistance of the pressure chamber is the one resistance;

if the calculated resistance value of the pressure chamber is less than the second predetermined value, the resistance of the ejecting nozzle is the one resistance; and performing the processing using the amount of the liquid preliminarily ejected or suctioned so as to satisfy the following equation:

$$v1<v2<v3,$$

wherein v1 represents the amount of liquid when the resistance calculated as the one resistance is the resistance of the supply passage, v2 represents the amount of liquid when the resistance calculated as the one resistance is the resistance of the pressure chamber, and v3 represents the amount of liquid when the resistance calculated as the one resistance is the resistance of the ejecting nozzle.

* * * * *